US009605329B2

(12) United States Patent
Nonaka et al.

(10) Patent No.: US 9,605,329 B2
(45) Date of Patent: Mar. 28, 2017

(54) COLD ROLLED STEEL SHEET AND MANUFACTURING METHOD THEREOF

(71) Applicant: Nippon Steel & Sumitomo Metal Corporation, Tokyo (JP)

(72) Inventors: Toshiki Nonaka, Tokyo (JP); Satoshi Kato, Tokyo (JP); Kaoru Kawasaki, Tokyo (JP); Toshimasa Tomokiyo, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 246 days.

(21) Appl. No.: 14/371,214

(22) PCT Filed: Jan. 11, 2013

(86) PCT No.: PCT/JP2013/050382
§ 371 (c)(1),
(2) Date: Jul. 9, 2014

(87) PCT Pub. No.: WO2013/105632
PCT Pub. Date: Jul. 18, 2013

(65) Prior Publication Data

US 2014/0370329 A1 Dec. 18, 2014

(30) Foreign Application Priority Data

Jan. 13, 2012 (JP) ..... 2012-004551

(51) Int. Cl.
*C22C 38/02* (2006.01)
*C22C 38/04* (2006.01)
(Continued)

(52) U.S. Cl.
CPC ..... *C21D 8/0236* (2013.01); *C21D 8/0263* (2013.01); *C21D 8/0273* (2013.01);
(Continued)

(58) Field of Classification Search
None
See application file for complete search history.

(56) References Cited

U.S. PATENT DOCUMENTS

2007/0023113 A1 2/2007 Ikeda et al.
2011/0240176 A1 10/2011 Kaneko et al.
2012/0175028 A1* 7/2012 Matsuda ..... C21D 8/0205 148/645

FOREIGN PATENT DOCUMENTS

CA 2787575 A1 8/2011
CN 101802233 8/2010
(Continued)

OTHER PUBLICATIONS

Machine-English translation of JP2008-156734, Kawabe Hidenao et al., Jul. 10, 2008.*
(Continued)

*Primary Examiner* — Deborah Yee
(74) *Attorney, Agent, or Firm* — Birch, Stewart, Kolasch & Birch, LLP

(57) ABSTRACT

When the amount of C, the amount of Si and the amount of Mn are respectively represented by [C], [Si] and [Mn] in unit mass %, the cold rolled steel sheet satisfies a relationship of (5×[Si]+[Mn])/[C]>10, the metallographic structure contains, by area ratio, 40% to 90% of a ferrite and 10% to 60% of a martensite, further contains one or more of 10% or less of a pearlite by area ratio, 5% or less of a retained austenite by volume ratio and 20% or less of a bainite by area ratio, the hardness of the martensite measured using a nanoindenter satisfies H20/H10<1.10 and σHM0<20, and TS×λ representing the product of TS that is a tensile strength and λ that is a hole expansion ratio is 50000 MPa·% or more.

19 Claims, 6 Drawing Sheets

(51) Int. Cl.

| | |
|---|---|
| ***C22C 38/18*** | (2006.01) |
| ***C22C 38/42*** | (2006.01) |
| ***C21D 8/04*** | (2006.01) |
| ***C21D 8/02*** | (2006.01) |
| ***C23C 2/02*** | (2006.01) |
| ***C23C 2/06*** | (2006.01) |
| ***C23C 2/12*** | (2006.01) |
| ***C23C 2/26*** | (2006.01) |
| ***C23C 2/28*** | (2006.01) |
| ***C21D 9/48*** | (2006.01) |
| ***C22C 38/00*** | (2006.01) |
| ***C22C 38/06*** | (2006.01) |
| ***C22C 38/12*** | (2006.01) |
| ***C22C 38/14*** | (2006.01) |
| ***C22C 38/08*** | (2006.01) |
| ***C22C 38/16*** | (2006.01) |
| ***C22C 38/22*** | (2006.01) |
| ***C22C 38/28*** | (2006.01) |
| ***C22C 38/32*** | (2006.01) |
| ***C22C 38/38*** | (2006.01) |
| ***C25D 5/36*** | (2006.01) |

(52) U.S. Cl.

CPC ..... *C21D 9/48* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/22* (2013.01); *C22C 38/28* (2013.01); *C22C 38/32* (2013.01); *C22C 38/38* (2013.01); *C23C 2/02* (2013.01); *C23C 2/06* (2013.01); *C23C 2/12* (2013.01); *C23C 2/26* (2013.01); *C23C 2/28* (2013.01); *C25D 5/36* (2013.01); *C21D 8/0226* (2013.01); *C21D 2211/005* (2013.01); *C21D 2211/008* (2013.01); *Y10T 428/12757* (2015.01); *Y10T 428/12799* (2015.01)

(56) References Cited

FOREIGN PATENT DOCUMENTS

| | | | | |
|---|---|---|---|---|
| CN | 2403311 | C2 | 11/2010 | |
| CN | 101939457 | | 1/2011 | |
| CN | 102227511 | | 10/2011 | |
| EP | 2128295 | | 12/2009 | |
| EP | 2264206 | | 12/2010 | |
| EP | 2 803 746 | A1 | 11/2014 | |
| JP | 01-172524 | | 7/1989 | |
| JP | 06-128688 | | 5/1994 | |
| JP | 11-189842 | | 7/1999 | |
| JP | 2000-319756 | | 11/2000 | |
| JP | 2001-355044 | | 12/2001 | |
| JP | 2003-193192 | | 7/2003 | |
| JP | 2004-018912 | | 1/2004 | |
| JP | 2005-120436 | | 5/2005 | |
| JP | 2005-256141 | | 9/2005 | |
| JP | 2007314817 | | 12/2007 | |
| JP | 2008-156734 | * | 7/2008 | ..... C22C 38/00 |
| JP | 20 10-065292 | | 3/2010 | |
| JP | 2011144409 | | 7/2011 | |
| JP | 2003-313636 | | 11/2013 | |
| RU | 2312162 | C2 | 12/2007 | |
| RU | 2312920 | C2 | 12/2007 | |
| RU | 2379373 | C1 | 1/2010 | |
| RU | 2395593 | C1 | 7/2010 | |
| RU | 2437945 | C2 | 6/2011 | |
| RU | 2437945 | C2 | 12/2011 | |
| RU | 2439189 | C1 | 1/2012 | |
| WO | 2011013845 | | 2/2011 | |
| WO | 2011/025042 | A1 | 3/2011 | |
| WO | WO2011/087057 | | 7/2011 | |
| WO | WO 2011/132763 | A1 | 10/2011 | |
| WO | 2011142356 | | 11/2011 | |
| WO | WO2011/158818 | | 12/2011 | |

OTHER PUBLICATIONS

Office Action dated Oct. 8, 2015 issued in corresponding Korean Application No. 10-2014-7019659.

Office Action dated Oct. 8, 2015 issued in related Korean Application No. 10-2014-7019669.

Notice of Allowance issued on Nov. 27, 2015 in corresponding RU Application No. 2014129328.

Notice of Allowance issued on Nov. 27, 2015 in corresponding RU Application No. 2014129326.

Office Action issued on Nov. 30, 2015 in corresponding CA Application No. 2,862,810.

Search Report dated Feb. 17, 2016 issued in corresponding European Application No. 13736290.1.

Office Action dated Aug. 19, 2015 issued in Chinese Application No. 201380005142.0. [with English Translation].

Office Action dated Aug. 28, 2015 issued in Chinese Application No. 201380005178.9. [with English Translation].

International Search Report dated Apr. 16, 2013 issued in corresponding PCT Application No. PCT/JP2013/050382 [with English Translation].

International Search Report dated Apr. 16, 2013 issued in PCT Application No. PCT/JP2013/050377 [with English Translation].

Office Action dated Apr. 24, 2014 issued in Taiwanese Application No. 102101294 [with English Translation].

Office Action dated Apr. 24, 2014 issued in Taiwanese Application No. 102101296 [with English Translation].

Canadian Office Action dated Jun. 28, 2016, issued in Canadian Patent Application No. 2,862,810.

Search Report dated May 2, 2016 issued in corresponding European Application No. 13735919.6.

* cited by examiner

COLD ROLLED STEEL SHEET AND MANUFACTURING METHOD THEREOF

This application is a national stage application of International Application No. PCT/JP2013/050382, filed Jan. 11, 2013, which claims priority to Japanese Patent Application No. 2012-004551, filed on Jan. 13, 2012, each of which is incorporated by reference in its entirety.

TECHNICAL FIELD OF THE INVENTION

The present invention relates to a cold rolled steel sheet having excellent formability before hot stamping and/or after hot stamping, and a manufacturing method thereof. The cold rolled steel sheet of the present invention includes a cold rolled steel sheet, a hot-dip galvanized cold rolled steel sheet, a galvannealed cold rolled steel sheet, an electrogalvanizing cold rolled steel sheet and an aluminizing cold rolled steel sheet.

RELATED ART

Currently, a steel sheet for a vehicle is required to be improved for collision safety and have a reduced weight. Currently, there is demand for a higher-strength steel sheet in addition to 980 MPa (980 MPa or higher)-class steel sheets and 1180 MPa (1180 MPa or higher)-class steel sheets in terms of tensile strength. For example, there is a demand for a steel sheet having a tensile strength of more than 1.5 GPa. In the above-described circumstance, hot stamping (also called hot pressing, diequenching, press quenching or the like) is drawing attention as a method for obtaining high strength. The hot stamping refers to a forming method in which a steel sheet is heated at a temperature of 750° C. or higher, hot-formed (worked) so as to improve the formability of the high-strength steel sheet, and then cooled so as to quench the steel sheet, thereby obtaining desired material qualities.

A steel sheet having a ferrite and martensite, a steel sheet having a ferrite and bainite, a steel sheet containing retained austenite in the structure or the like is known as a steel sheet having both press formability and high strength. Among the above-described steel sheets, a multi-phase steel sheet having martensite dispersed in a ferrite base (steel sheet including ferrite and martensite, that is. DP steel sheet) has a low yield ratio and high tensile strength, and furthermore, excellent elongation characteristics. However, the multi-phase steel sheet has a poor hole expansibility since stress concentrates at the interface between ferrite and martensite, and cracking is likely to originate from the interface. In addition, a steel sheet having the above-described multi phases is not capable of exhibiting 1.5 GPa-class tensile strength.

For example, Patent Documents 1 to 3 disclose multi-phase steel sheets as described above. In addition, Patent Documents 4 to 6 describe the relationship between the hardness and formability of a high-strength steel sheet.

However, even with the above-described techniques of the related art, it is difficult to satisfy the current requirements for a vehicle such as additional reduction of weight, additional increase in strength and more complicated component shapes.

PRIOR ART DOCUMENT

Patent Document

[Patent Document 1] Japanese Unexamined Patent Application, First Publication No. H6-128688

[Patent Document 2] Japanese Unexamined Patent Application, First Publication No. 2000-319756

[Patent Document 3] Japanese Unexamined Patent Application. First Publication No. 2005-120436

[Patent Document 4] Japanese Unexamined Patent Application. First Publication No. 2005-256141

[Patent Document 5] Japanese Unexamined Patent Application, First Publication No. 2001-355044

[Patent Document 6] Japanese Unexamined Patent Application, First Publication No. H11-189842

DISCLOSURE OF THE INVENTION

Problems to be Solved by the Invention

The present invention has been made in consideration of the above-described problem. That is, an object of the present invention is to provide a cold rolled steel sheet which has excellent formability and is capable of obtaining favorable hole expansibility together with strength, and a manufacturing method thereof. Furthermore, another object of the present invention is to provide a cold rolled steel sheet capable of ensuring a strength of 1.5 GPa or more, preferably 1.8 GPa or more, and 2.0 GPa or more after hot stamping forming and of obtaining more favorable hole expansibility, and a manufacturing method thereof.

Means for Solving the Problem

The present inventors carried out intensive studies regarding a high-strength cold rolled steel sheet which ensures strength before hot stamping (before heating in a hot stamping process including heating at a temperature in a range of 750° C. to 1000° C. working and cooling) and has excellent formability such as hole expansibility. Furthermore, the inventors carried out intensive studies regarding a cold rolled steel sheet which ensures strength of 1.5 GPa or more, preferably 1.8 GPa or more, and 2.0 GPa or more after hot stamping (after working and cooling in the hot stamping process) and has excellent formability such as hole expansibility. As a result, it was found that, in a cold rolled steel sheet, more favorable formability than ever, that is, the product of tensile strength TS and hole expansion ratio λ (TS×λ) of 50000 MPa·% or more can be ensured by (i), with regard to the steel components, establishing an appropriate relationship among the amounts of Si, Mn and C, (ii) adjusting the fractions of ferrite and martensite to predetermined fractions, and (iii) adjusting the rolling reduction of cold rolling so as to obtain a hardness ratio (hardness difference) of martensite between surface part of a sheet thickness and center portion of the sheet thickness (central part) of the steel sheet and a hardness distribution of martensite at the central part in a specific range. In addition, it was found that, when the cold rolled steel sheet obtained in the above-described manner is used for hot stamping within a certain condition range, the hardness ratio of martensite between the surface part of the sheet thickness and the central part of the cold rolled steel sheet and the hardness distribution of martensite at the center portion of the sheet thickness are rarely changed even after hot stamping, and therefore a cold rolled steel sheet (hot stamped steel) having high strength and excellent formability can be obtained. In addition, it was also clarified that suppression of the segregation of MnS at the center portion of the sheet thickness of the cold rolled steel sheet is effective to improve the hole expansibility both in the cold rolled steel sheet before hot stamping and in the cold rolled steel sheet after hot stamping.

In addition, it was also found that, in cold rolling for which a cold rolling mill having a plurality of stands is used, the adjustment of the fraction of the cold rolling rate in each of the uppermost to third stands in the total cold rolling rate (cumulative rolling rate) to a specific range is effective to control the hardness of martensite. Based on the above-described finding, the inventors have found a variety of aspects of the present invention described below. In addition, it was found that the effects are not impaired even when hot dip galvanizing, galvannealing, electrogalvanizing and aluminizing are carried out on the cold rolled steel sheet.

(1) That is, according to a first aspect of the present invention, there is provided a cold rolled steel sheet containing, by mass %, C: more than 0.150% to 0.300%, Si: 0.010/0% to 1.000%, Mn: 1.50% to 2.70%, P: 0.001% to 0.060%, S: 0.001% to 0.010%, N: 0.0005% to 0.0100% and Al: 0.010% to 0.050%, and optionally containing one or more of B: 0.0005% to 0.0020%, Mo: 0.01% to 0.50%. Cr: 0.01% to 0.50%, V: 0.001% to 0.100%, Ti: 0.0010% to 0.100%, Nb: 0.0010% to 0.050%, Ni: 0.01% to 1.00%, Cu: 0.01% to 1.00%, Ca: 0.0005% to 0.0050% and REM: 0.0005% to 0.0050%, and a balance including Fe and unavoidable impurities, in which, when an amount of C, an amount of Si and an amount of Mn are respectively represented by [C], [Si] and [Mn] in unit mass %, a relationship of the following formula 1 is satisfied, a metallographic structure contains, by area ratio, 40% to 90% of a ferrite and 10% to 60% of a martensite, further contains one or more of 10% or less of a pearlite by area ratio, 5% or less of a retained austenite by volume ratio and 20% or less of a bainite by area ratio, a hardness of the martensite measured using a nanoindenter satisfies the following formulae 2a and 3a, and TS×λ representing a product of TS that is a tensile strength and λ that is a hole expansion ratio is 50000 MPa·% or more.

$$(5\times[Si]+[Mn])/[C]>10 \quad (1)$$

$$H20/H10<1.10 \quad (2a)$$

$$\sigma HM0<20 \quad (3a)$$

Here, the H10 represents an average hardness of the martensite at the surface part of the cold rolled steel sheet, the H20 represents an average hardness of the martensite at a center portion of a sheet thickness that occupies a ±100 μm range from a sheet thickness center of the cold rolled steel sheet in a thickness direction, and the σHM0 represents a variance of the hardness of the martensite present in the ±100 μm range from the center portion of the sheet thickness in the thickness direction.

(2) In the cold rolled steel sheet according to the above (1), an area ratio of an MnS that is present in the metallographic structure and has an equivalent circle diameter in a range of 0.1 μm to 10 μm may be 0.01% or less, and the following formula 4a may be satisfied.

$$n20/n10<1.5 \quad (4a)$$

Here, the n10 represents an average number density of the MnS per 10000 $\mu m^2$ at a ¼ part of the sheet thickness of the cold rolled steel sheet, and the n20 represents an average number density of the MnS per 10000 $\mu m^2$ at the center portion of the sheet thickness.

(3) In the cold rolled steel sheet according to the above (1), additionally, after a hot stamping including heating at a temperature in a range of 750° C. to 1000° C., a working and a cooling, is carried out, the hardness of the martensite measured using a nanoindenter may satisfy the following formulae 2b and 3b, the metallographic structure may contain 80% or more of a martensite by area ratio, optionally, further contain one or more of 10% or less of a pearlite by area ratio, 5% or less of a retained austenite by volume ratio, less than 20% of a ferrite and less than 20% of a bainite by area ratio, and TS×λ representing the product of TS that is the tensile strength and λ that is the hole expansion ratio may be 50000 MPa·% or more.

$$H2/H1<1.10 \quad (2b)$$

$$\sigma HM<20 \quad (3b)$$

Here, the H2 represents an average hardness of the martensite at the surface part after the hot stamping, the H2 represents an average hardness of the martensite at the center portion of the sheet thickness after the hot stamping, and σHM represents a variance of the hardness of the martensite present at the center portion of the sheet thickness after the hot stamping.

(4) In the cold rolled steel sheet according to the above (3), an area ratio of MnS that is present in the metallographic structure and has an equivalent circle diameter in a range of 0.1 μm to 10 μm may be 0.01% or less, and the following formula 4b may be satisfied.

$$n2/n1<1.5 \quad (4b)$$

Here, the n1 represents an average number density of the MnS per 10000 $\mu m^2$ at a ¼ part of the sheet thickness in the cold rolled steel sheet after the hot stamping, and the n2 represents an average number density of the MnS per 10000 $\mu m^2$ at the center portion of the sheet thickness after the hot stamping.

(5) In the cold rolled steel sheet according to any one of the above (1) to (4), a hot-dip galvanized layer may be further formed on a surface of the cold rolled steel sheet.

(6) In the cold rolled steel sheet according to the above (5), the hot-dip galvanized layer may include a galvannealed layer.

(7) In the cold rolled steel sheet according to any one of the above (1) to (4), an electrogalvanizing layer may be further formed on a surface of the cold rolled steel sheet.

(8) In the cold rolled steel sheet according to any one of the above (1) to (4), an aluminizing layer may be further formed on a surface of the cold rolled steel sheet.

(9) According to another aspect of the present invention, there is provided a manufacturing method for a cold rolled steel sheet including a casting process of casting molten steel having the chemical components described in the above (1) and producing a steel; a heating process of heating the steel; a hot rolling process of carrying out hot rolling on the steel using a hot rolling facility having a plurality of stands; a coiling process of coiling the steel after the hot rolling process; a pickling process of carrying out pickling on the steel after the coiling process; a cold rolling process of carrying out cold rolling on the steel after the pickling process using a cold rolling mill having a plurality of stands under conditions in which the following formula 5 is satisfied; an annealing process of carrying out heating at a temperature in a range of 700° C. to 850° C. and cooling on the steel after the cold rolling process; and a temper rolling process of carrying out temper rolling on the steel after the annealing process.

$$1.5\times r1/r+1.2\times r2/r+r3/r>1.0 \quad (5)$$

Here, ri represents an individual target cold rolling reduction in an $i^{th}$ stand from the uppermost stand among a plurality of the stands in the cold rolling process in unit % where i is 1, 2 or 3, and r represents a total cold rolling reduction in the cold rolling process in unit %.

(10) In the manufacturing method of manufacturing a cold rolled steel sheet according to the above (9), when a coiling temperature in the coiling process is represented by CT in unit ° C.; and an amount of C, an amount of Mn, an amount of Si and an amount of Mo of the steel are respectively represented by [C], [Mn], [Si] and [Mo] in unit mass %, the following formula 6 may be satisfied.

$$560-474\times[C]-90\times[Mn]-20\times[Cr]-20\times[Mo]<CT<830-270\times[C]-90\times[Mn]-70\times[Cr]-80\times[Mo] \quad (6)$$

(11) In the manufacturing method of manufacturing a cold rolled steel sheet according to the above (9) or (10), when a heating temperature in the heating process is represented by T in unit ° C. an in-furnace time is represented by t in unit minute; and an amount of Mn and an amount of S in the steel are respectively represented by [Mn] and [S] in unit mass %; the following formula 7 may be satisfied.

$$T\times\ln(t)/(1.7\times[Mn]+[S])>1500 \quad (7)$$

(12) In the manufacturing method of manufacturing a cold rolled steel sheet according to any one of the above (9) to (11), a hot dip galvanizing process of carrying out hot dip galvanizing on the steel may be further included between the annealing process and the temper rolling process.

(13) In the manufacturing method of manufacturing a cold rolled steel sheet according to any one of the above (9) to (12), an alloying treatment process of carrying out an alloying treatment on the steel may be further included between the hot dip galvanizing process and the temper rolling process.

(14) In the manufacturing method of manufacturing a cold rolled steel sheet according to any one of the above (9) to (11), an electrogalvanizing process of carrying out electrogalvanizing on the steel may be further included after the temper rolling process.

(15) In the manufacturing method of manufacturing a cold rolled steel sheet according to any one of the above (9) to (11), an aluminizing process of carrying out aluminizing on the steel may be further included between the annealing process and the temper rolling process.

Effects of the Invention

According to the aspect of the present invention, since an appropriate relationship is established among the amount of C, the amount of Mn and the amount of Si, and martensite is given an appropriate hardness measured using a nanoindenter, it is possible to obtain a cold rolled steel sheet having favorable hole expansibility. Furthermore, it is possible to obtain a cold rolled steel sheet having favorable hole expansibility even after hot stamping.

Meanwhile, the cold rolled steel sheet according to the above (1) to (8) and hot stamped steels manufactured using the cold rolled steel sheet manufactured according to the above (9) to (15) have excellent formability.

EMBODIMENTS OF THE INVENTION

Figure 1:
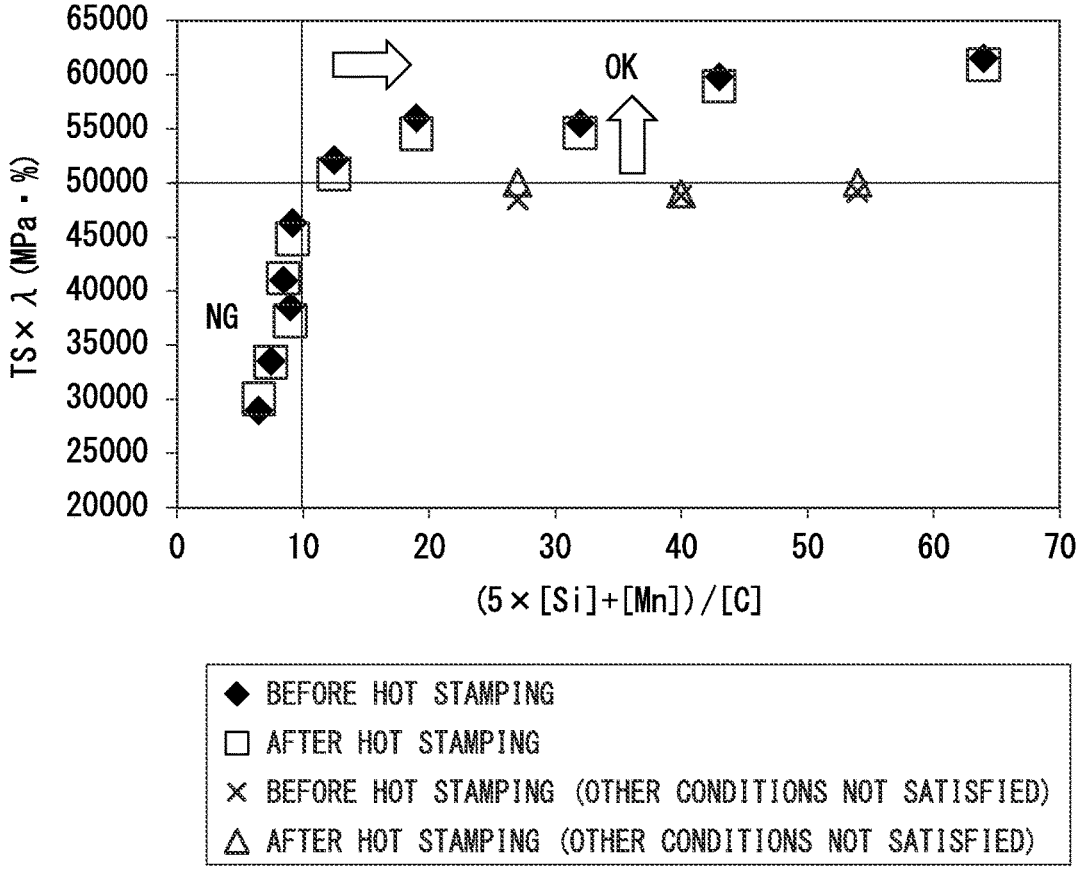
FIG. 1 is a graph illustrating a relationship between (5×[Si]+[Mn])/[C] and TS×λ.

As described above, it is important to establish an appropriate relationship among the amounts of Si, Mn and C and, furthermore, give an appropriate hardness to martensite at predetermined portions in the steel sheet to improve hole expansibility. Thus far, there have been no studies regarding the relationship between the formability of a cold rolled steel sheet and the hardness of martensite for both before and after hot stamping.

Hereinafter, an embodiment of the present invention will be described in detail.

First, a cold rolled steel sheet according to an embodiment of the present invention and the reasons for limiting the chemical components of steel used for the manufacturing of the cold rolled steel sheet will be described. Hereinafter, "%" that is the unit of the amount of each component indicates "mass %".

Meanwhile, in the present embodiment, for convenience, a cold rolled steel sheet that has not been subjected to hot stamping will be called, simply, a cold rolled steel sheet, a cold rolled steel sheet before hot stamping or a cold rolled steel sheet according to the embodiment, and a cold rolled steel sheet that has been subjected to hot stamping (worked through hot stamping) will be called a cold rolled steel sheet after hot stamping or a cold rolled steel sheet after hot stamping according to the embodiment.

C: more than 0.150% to 0.300%

C is an important element to strengthen ferrite and martensite and increase the strength of steel. However, when the amount of C is 0.150% or less, a sufficient amount of martensite cannot be obtained, and it is not possible to sufficiently increase the strength. On the other hand, when the amount of C exceeds 0.300%, elongation or hole expansibility significantly degrades. Therefore, the range of the amount of C is set to more than 0.150% and 0.300% or less.

Si: 0.010% to 1.000%

Si is an important element to suppress the generation of a harmful carbide and to obtain multi-phases mainly including ferrite and martensite. However, when the amount of Si exceeds 1.000%, elongation or hole expansibility degrades, and the chemical conversion property also degrades. Therefore, the amount of Si is set to 1.000% or less. In addition, Si is added for deoxidation, but the deoxidation effect is not sufficient at an amount of Si of less than 0.010%. Therefore, the amount of Si is set to 0.010% or more.

Al: 0.010% to 0.050%

Al is an important element as a deoxidizing agent. To obtain the deoxidation effect, the amount of Al is set to 0.010% or more. On the other hand, even when Al is excessively added, the above-described effect is saturated, and conversely, steel becomes brittle, and TS×λ is decreased. Therefore, the amount of Al is set in a range of 0.010%0 to 0.050%.

Mn: 1.50% to 2.70%

Mn is an important element to improve hardenability and strengthen steel. However, when the amount of Mn is less than 1.50%, it is not possible to sufficiently increase the strength. On the other hand, when the amount of Mn exceeds 2.70%, the hardenability becomes excessive, and elongation or hole expansibility degrades. Therefore, the amount of Mn is set to 1.50% to 2.70%. In a case in which higher elongation is required, the amount of Mn is desirably set to 2.00% or less.

P: 0.001% to 0.060%

At a large amount, P segregates at the grain boundaries, and deteriorates local elongation and weldability. Therefore, the amount of P is set to 0.060% or less. The amount of P is desirably smaller, but an extreme decrease in the P content leads to an increase in the cost of refining, and therefore the amount of P is desirably set to 0.001% or more.

S: 0.001% to 0.010%

S is an element that forms MnS and significantly deteriorates local elongation or weldability. Therefore, the upper limit of the amount of S is set to 0.010%. In addition, the amount of S is desirably smaller; however, due to a problem of refining costs, the lower limit of the amount of S is desirably set to 0.001%.

N: 0.0005% to 0.0100%

N is an important element to precipitate AlN and the like and miniaturize crystal grains. However, when the amount of N exceeds 0.0100%, nitrogen solid solution remains and elongation or hole expansibility is degraded. Therefore, the amount of N is set to 0.0100% or less. Meanwhile, the amount of N is desirably smaller; however, due to the problem of refining costs, the lower limit of the amount of N is desirably set to 0.0005%.

The cold rolled steel sheet according to the embodiment has a basic composition having the above-described components and a remainder of iron and unavoidable impurities, but can further contain any one or more elements of Nb, Ti, V, Mo, Cr. Ca, REM (rare earth metal), Cu, Ni and B as elements that have thus far been used in amounts of the below-described upper limit or less to improve strength, control the shape of a sulfide or an oxide, and the like. The above-described chemical elements are not always added to the steel sheet, and therefore the lower limit thereof is 0%.

Nb, Ti and V are elements that precipitate fine carbonitride and strengthen steel. In addition, Mo and Cr are elements that improve hardenability and strengthen steel. To obtain the above-described effects, it is desirable to contain 0.001% or more of Nb, 0.001% or more of Ti, 0.001% or more of V, 0.01% or more of Mo and 0.01% or more of Cr. However, even when more than 0.050% of Nb, more than 0.100% of Ti, more than 0.100% of V, more than 0.50% of Mo, and more than 0.50% of Cr are contained, the strength-increasing effect is saturated, and the degradation of elongation or hole expansibility is caused. Therefore, the upper limits of Nb, Ti, V, Mo and Cr are set to 0.050%, 0.100%, 0.100%, 0.50% and 0.50%, respectively.

Steel can further contain Ca in a range of 0.0005% to 0.0050%. Ca controls the shape of a sulfide or an oxide and improve local elongation or hole expansibility. To obtain the above-described effect, it is desirable to contain 0.0005% or more of Ca. However, when an excessive amount of Ca is contained, workability deteriorates, and therefore the upper limit of the amount of Ca is set to 0.0050%. For the same reason, the lower limit is set to 0.0005%, and the upper limit of rare earth element (REM) is set to 0.0050%.

Steel can further contain Cu in a range of 0.01% to 1.00%, Ni in a range of 0.01% to 1.00% and B in a range of 0.0005% to 0.0020%. The above-described elements also can improve hardenability and increase the strength of steel. However, to obtain the above-described effect, it is desirable to contain 0.01% or more of Cu, 0.01% or more of Ni and 0.0005% or more of B. In the above-described amounts or less, the effect that strengthens steel is small. On the other hand, even when more than 1.00% of Cu, more than 1.00% of Ni and more than 0.0020% of B are added, the strength-increasing effect is saturated, and the elongation or hole expansibility degrades. Therefore, the upper limits of the amount of Cu, the amount of Ni and the amount of B are set to 1.00%, 1.00% and 0.0020% respectively.

In a case in which steel contains B, Mo, Cr, V, Ti. Nb, Ni. Cu, Ca and REM, at least one element is contained. The remainder of steel includes Fe and unavoidable impurities. Steel may further contain elements other than the above-described elements (for example, Sn, As and the like) as the unavoidable impurities as long as the characteristics are not impaired. B, Mo, Cr, V, Ti, Nb, Ni, Cu, Ca and REM being contained in amounts less than the above-described lower limits are treated as unavoidable impurities.

Meanwhile, since there is no change in the chemical components even after hot stamping, the chemical components still satisfy the above-described ranges even in the steel sheet after hot stamping.

In addition, in the cold rolled steel sheet according to the embodiment and the cold rolled steel sheet after hot stamping according to the embodiment, when the amount of C (mass %), the amount of Si (mass %) and the amount of Mn (mass %) are represented by [C], [Si] and [Mn] respectively, it is important to satisfy the relationship of the following formula 1 to obtain sufficient hole expansibility as illustrated in FIG. 1.

$$(5\times[Si]+[Mn])/[C]>10 \quad (1)$$

When the value of (5×[Si]+[Mn])/[C] is 10 or less, TS×λ becomes less than 50000 MPa·%, and it is not possible to obtain sufficient hole expansibility. This is because, when the C content is high, the hardness of a hard phase becomes too high, the difference from the hardness of a soft phase becomes great, and therefore the λ value deteriorates, and, when the Si content or the Mn content is small, TS becomes low. Therefore, it is necessary to control the balance among the amounts of the respective elements in addition to containing the elements in the above-described ranges. The value of (5×[Si]+[Mn])/[C] does not change due to rolling or hot stamping. However, even when (5×[Si]+[Mn])/[C]>10 is satisfied, in a case in which the below-described hardness ratio of martensite (H20/H10, H2/H1) or the dispersion of the martensite hardness (σHM0, σHM) does not satisfy the conditions, sufficient hole expansibility cannot be obtained in the cold rolled steel sheet or the cold rolled steel sheet after hot stamping.

Next, the reason for limiting the metallographic structure of the cold rolled steel sheet according to the embodiment and the cold rolled steel sheet after hot stamping according to the embodiment will be described.

Figure 2A:
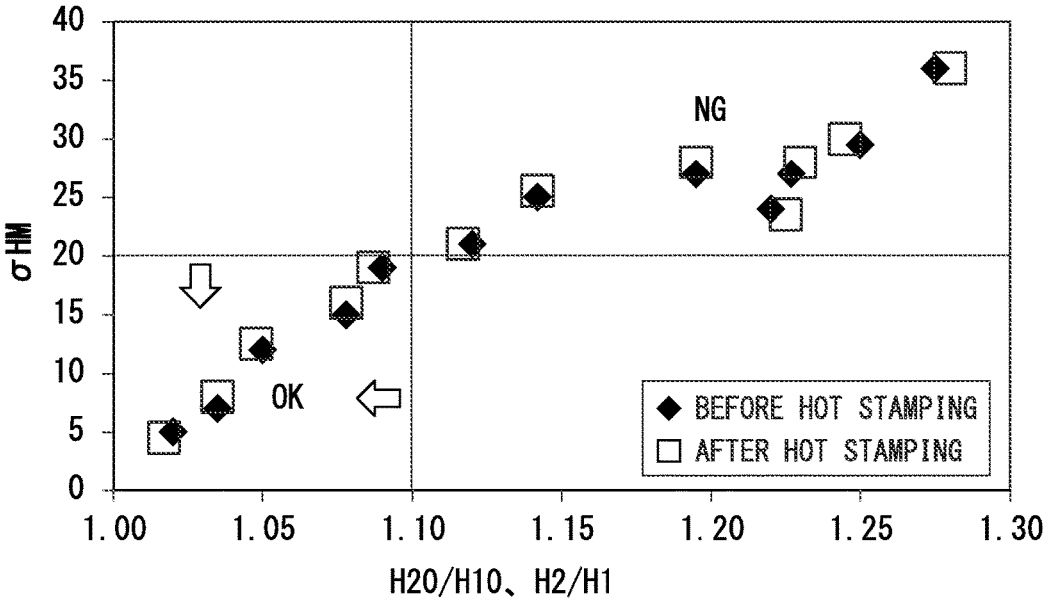
FIG. 2A is a graph illustrating the foundation of Formulae 2a, 2b, 3a and 3b, and is a graph illustrating a relationship between H20/H10 and σHM0 of a cold rolled steel sheet before hot stamping and a relationship between H2/H1 and σHM of a cold rolled steel sheet after hot stamping.
Figure 2B:
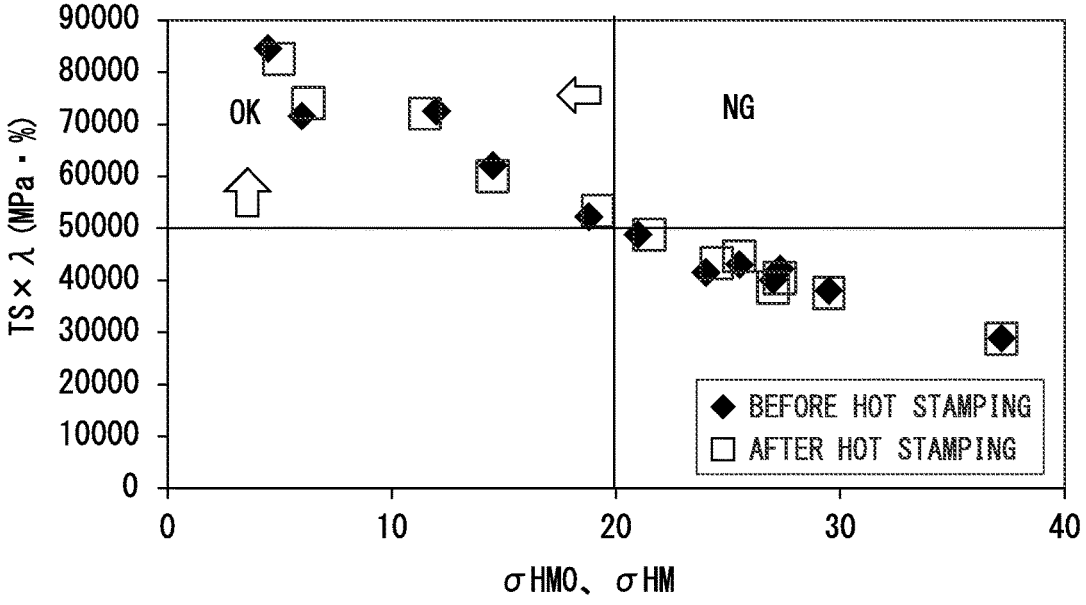
FIG. 2B is a graph illustrating the foundation of Formulae 3a and 3b, and is a graph illustrating a relationship between σHM0 before hot stamping and σHM after hot stamping, and TS×λ.

Generally, in the cold rolled steel sheet having a metallographic structure mainly including ferrite and martensite, the dominant factor for formability such as hole expansibility is martensite rather than ferrite. The inventors carried out intensive studies regarding the relationship between the hardness of martensite and formability such as elongation or hole expansibility. As a result, it was found that, as illustrated in FIGS. 2A and 2B, formability such as elongation or hole expansibility becomes favorable as long as the hardness ratio (hardness difference) of martensite between the surface part of the sheet thickness and the center portion of the sheet thickness and the hardness distribution of martensite at the center portion of the sheet thickness are in predetermined states in both the cold rolled steel sheet and the cold rolled steel sheet after hot stamping. In addition, it was found that the hardness ratio of martensite and the hardness distribution of martensite in the cold rolled steel sheet before hot stamping were rarely changed in the cold rolled steel sheet after hot stamping obtained by carrying out quenching through hot stamping on a cold rolled steel sheet having favorable formability, and consequently, formability such as elongation or hole expansibility was favorable. This is because the hardness distribution of martensite generated in the cold rolled steel sheet before hot stamping still has a significant effect even after hot stamping. Specifically, this is considered to be because alloy elements concentrated at the center portion of the sheet thickness still remain at the center portion of the sheet thickness in a concentrated state even after hot stamping. That is, in a case in which the hardness ratio of martensite between the surface part of the sheet thickness and the center portion of the sheet thickness is great or a case in which the variance of the hardness of martensite at the center portion of the sheet thickness is great, the same hardness ratio and the same variance are obtained even after hot stamping.

Furthermore, regarding the hardness measurement of martensite measured at a magnification of 1000 times using a nanoindenter manufactured by Hysitron Corporation, the inventors found that, in the cold rolled steel sheet before hot stamping, formability was improved by satisfying the following formulae 2a and 3a. In addition, regarding the above-described relationships, the inventors found that, the cold rolled steel sheet after hot stamping, similarly, formability was improved by satisfying the following formulae 2b and 3b.

$$H20H10<1.10 \quad (2a)$$

$$\sigma HM0<20 \quad (3a)$$

$$H2/H1<1.10 \quad (2b)$$

$$\sigma HM<20 \quad (3b)$$

Here, H10 represents the hardness of martensite at the surface part of the sheet thickness of the cold rolled steel sheet before hot stamping which is 200 μm or less from the outermost layer in the thickness direction. H20 represents the hardness of martensite at the center portion of the sheet thickness of the cold rolled steel sheet before hot stamping, that is, martensite in a ±100 μm range from the sheet thickness center in the thickness direction. σHM0 represents the variance of the hardness of martensite present in the ±100 μm range from the sheet thickness center of the cold rolled steel sheet before hot stamping in the thickness direction.

In addition, H1 represents the hardness of martensite at the surface part of the sheet thickness of the cold rolled steel sheet after hot stamping which is 200 μm or less from the outermost layer in the thickness direction. H2 represents the hardness of martensite at the center portion of the sheet thickness of the cold rolled steel sheet after hot stamping, that is, martensite in a ±100 μm range from the sheet thickness center in the thickness direction. σHM represents the variance of the hardness of martensite present in the ±100 μm range from the sheet thickness center of the cold rolled steel sheet after hot stamping in the thickness direction.

The hardness is measured at 300 points for each. The ±100 μm range from the sheet thickness center in the thickness direction refers to a range having a center at the sheet thickness center and having a size of 200 μm in the thickness direction.

In addition, the variance of the hardness σHM0 or σHM is obtained using the following formula 8, and indicates the distribution of the hardness of martensite. Meanwhile, σHM in the formula represents σHM0 and is expressed as σHM.

[Formula 1]

$$\sigma HM = \frac{1}{n}\sum_{i=1}^{n}(x_{ave} - x_i)^2 \quad (8)$$

$X_{ave}$ represents the average value of the measured hardness of martensite, and $X_i$ represents the hardness of $i^{th}$ martensite. Meanwhile, the formula is still valid even when σHM is replaced by σHM0.

FIG. 2A illustrates the ratios between the hardness of martensite at the surface part and the hardness of martensite at the center portion of the sheet thickness in the cold rolled steel sheet before hot stamping and the cold rolled steel sheet after hot stamping. In addition, FIG. 2B collectively illustrates the variance s of the hardness of martensite present in the ±100 μm range from the sheet thickness center in the thickness direction of the cold rolled steel sheet before hot stamping and the cold rolled steel sheet after hot stamping. As illustrated in FIGS. 2A and 2B, the hardness ratio of the cold rolled steel sheet before hot stamping and the hardness ratio of the cold rolled steel sheet after hot stamping are almost the same. In addition, the variance s of the hardness of martensite at the center portion of the sheet thickness are also almost the same both in the cold rolled steel sheet before hot stamping and in the cold rolled steel sheet after hot stamping. Therefore, it is found that the formability of the cold rolled steel sheet after hot stamping is as excellent as the formability of the cold rolled steel sheet before hot stamping The value of H20/H10 or H2/H1 being 1.10 or more indicates that, in the cold rolled steel sheet before hot stamping or the cold rolled steel sheet after hot stamping, the hardness of martensite at the center portion of the sheet thickness is 1.10 or more times the hardness of martensite at the surface part of the sheet thickness. That is, the value indicates that the hardness at the center portion of the sheet thickness becomes too high. As illustrated in FIG. 2A, when H20/H10 is 1.10 or more, σHM0 reaches 20 or more, and, when H2/H1 is 1.10 or more, σHM reaches 20 or more. In this case, TS×λ becomes smaller than 50000 MPa·%, and sufficient formability is not obtained both before quenching (that is, before hot stamping) and after quenching (that is, after hot stamping). Furthermore, theoretically, there is a case in which the lower limits of H20/H10 and H2/H1 are the same at the center portion of the sheet thickness and at the surface part of the sheet thickness as long as no special thermal treatment is carried out; however, in an actual production process considering productivity, the lower limits are, for example, down to approximately 1.005.

The variance σHM0 or σHM being 20 or more indicates that, in the cold rolled steel sheet before hot stamping and the cold rolled steel sheet after hot stamping, there is a great unevenness of the hardness of martensite, and there are local portions having excessively high hardness. In this case, TS×λ becomes smaller than 50000 MPa·%, and sufficient formability is not obtained.

Next, the metallographic structure of the cold rolled steel sheet according to the embodiment (before hot stamping) and the cold rolled steel sheet after hot stamping according to the embodiment will be described.

In the metallographic structure of the cold rolled steel sheet according to the embodiment, the ferrite area ratio is in a range of 40% to 90%. When the ferrite area ratio is less than 40%, the strength becomes too high even before hot stamping such that there is a case in which the shape of the steel sheet deteriorates or cutting becomes difficult. Therefore, the ferrite area ratio is set to 40% or more. On the other hand, in the cold rolled steel sheet according to the embodiment, since a large amount of alloy elements are added, it is difficult to set the ferrite area ratio to more than 90%. The metallographic structure includes not only ferrite but also martensite, and the area ratio of martensite is in a range of 10% to 60%. The sum of the ferrite area ratio and the martensite area ratio is desirably 60% or more. The metallographic structure may further include one or more of pearlite, bainite and retained austenite. However, when retained austenite remains in the metallographic structure, secondary working brittleness and delayed fracture characteristics are likely to degrade, and therefore it is preferable that the metallographic structure substantially includes no retained austenite. However, inevitably, retained austenite may be included in a volume ratio of 5% or less. Since pearlite is a hard and brittle structure, the metallographic structure preferably includes no pearlite; however, inevitably, pearlite may be included in an area ratio of up to 10%. Bainite is a structure that can be generated as a residual structure, and is an intermediate structure in terms of strength or formability. The absence of bainite does not make any difference, but the metallographic structure may include up to 20% of bainite by area ratio. In the embodiment, regarding the metallographic structure, ferrite, bainite and pearlite were observed through Nital etching, and martensite was observed through Le pera etching. The structures were all observed at a ¼ part of the sheet thickness at a magnification of 1000 times using an optical microscope. For retained austenite, the volume fraction was measured using an X-ray diffraction apparatus after polishing the steel sheet up to a quarter thickness-deep position.

In the metallographic structure of the cold rolled steel sheet after hot stamping according to the embodiment, the area ratio of martensite is 80% or more. When the area ratio of martensite is less than 80%, a sufficient strength required for a recent hot stamped steel (for example, 1.5 GPa or more) cannot be obtained. Therefore, the martensite area ratio is desirably set to 80% or more. All or the principal parts of the metallographic structure of the cold rolled steel sheet after hot stamping is occupied by martensite, but there is a case in which the remaining metallographic structure includes one or more of 10% or less of pearlite by area ratio, 5% or less of retained austenite by volume ratio, less than 20% of ferrite by area ratio and less than 20% of bainite by area ratio. Ferrite is present in a content range of 0% to less than 20% depending on the hot stamping conditions, and there is no problem with strength after hot stamping as long as ferrite is contained in the above-described range. In addition, when retained austenite remains in the metallographic structure, secondary working brittleness and delayed fracture characteristics are likely to degrade. Therefore, it is preferable that the metallographic structure substantially includes no retained austenite; however, inevitably, retained austenite may be included in a volume ratio of 5% or less. Since pearlite is a hard and brittle structure, the metallographic structure preferably includes no pearlite; however, inevitably, pearlite may be included in an area ratio of up to 10%. For the same reason, the metallographic structure may include up to 20% of bainite by area ratio. Similarly to the case of the cold rolled steel sheet before hot stamping, the metallographic structures were observed at a ¼ part of the sheet thickness at a magnification of 1000 times using an optical microscope after carrying out Nital etching for ferrite, bainite and pearlite and carrying out Le pera etching for martensite. For retained austenite, the volume fraction was measured using an X-ray diffraction apparatus after polishing the steel sheet up to a quarter thickness-deep position.

Meanwhile, hot stamping may perform according to a conventional method, for example, may include heating at a temperature in a range of 750° C. to 1000° C., working and cooling.

In the embodiment, the hardness of martensite measured in the cold rolled steel sheet before hot stamping and the cold rolled steel sheet after hot stamping using a nanoindenter at a magnification of 1000 times (indentation hardness (GPa or $N/mm^2$) or the value of Vickers hardness (Hv) converted from the indentation hardness) is specified. In an ordinary Vickers hardness test, an indentation larger than martensite is formed. Therefore, the macroscopic hardness of martensite and peripheral structures thereof (ferrite and the like) can be obtained, but it is not possible to obtain the hardness of martensite itself. Since formability such as hole expansibility is significantly affected by the hardness of martensite itself, it is difficult to sufficiently evaluate formability only with Vickers hardness. On the contrary, in the embodiment, since the hardness ratio and dispersion state of martensite measured using a nanoindenter are controlled in an appropriate range, it is possible to obtain extremely favorable formability.

Figure 3:
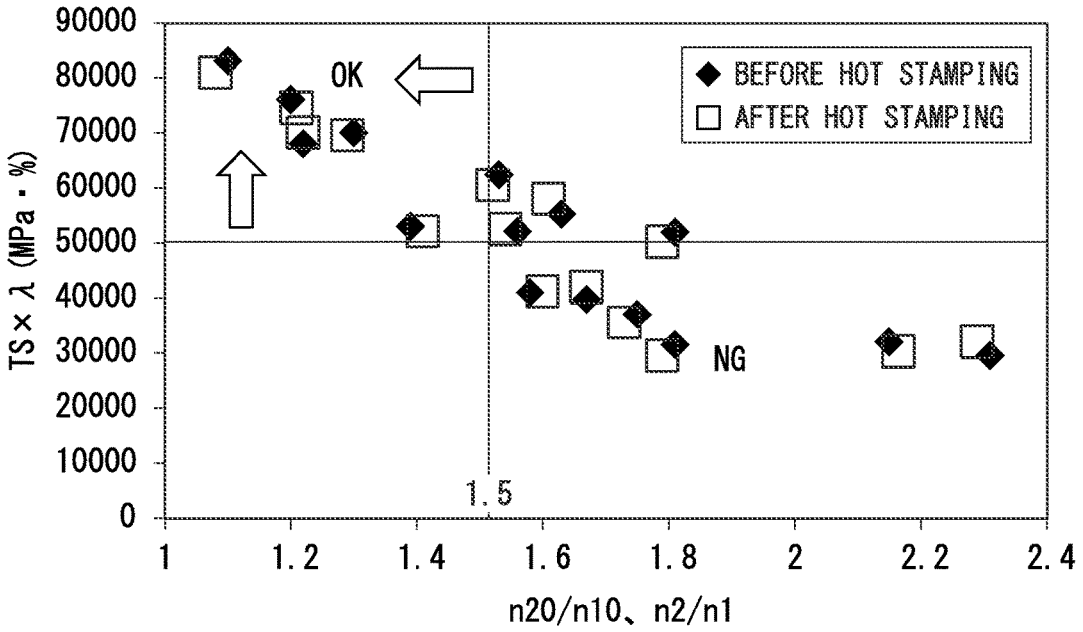
FIG. 3 is a graph illustrating a relationship between n20/n10 of the cold rolled steel sheet before hot stamping and n2/n1 of the cold rolled steel sheet after hot stamping, and TS×λ and illustrating the foundation of Formulae 4a and 4b.

MnS was observed at the quarter thickness-deep position (a location quarter the sheet thickness deep from the surface) and center portion of the sheet thickness of the cold rolled steel sheet according to the embodiment. As a result, it was found that the area ratio of MnS having an equivalent circle diameter in a range of 0.1 μm to 10 μm was 0.01% or less, and, as illustrated in FIG. 3, it is preferable to satisfy the following formula 4a in order to satisfy TS×λ≥50000 MPa·% favorably and stably. This is considered to be because, when MnS having an equivalent circle diameter of 0.1 μm is present in a hole expansibility test, stress concentrates around MnS, and therefore cracking becomes likely to occur. The reason for not counting MnS having an equivalent circle diameter of less than 0.1 μm is that such MnS has little effect on stress concentration. On the other hand, MnS that is larger than 10 μm is too large and is thus unsuitable for working. Furthermore, when the area ratio of MnS in a range of 0.1 μm to 10 μm exceeds 0.01%, it becomes easy for fine cracks generated due to stress concentration to propagate. Therefore, there is a case in which hole expansibility degrades.

$$n20/n10<1.5 \quad (4a)$$

Here, n10 represents the number density (grains/10000 $\mu m^2$) of MnS having an equivalent circle diameter in a range of 0.1 μm to 10 μm per unit area (10000 $\mu m^2$) at the ¼ part of the sheet thickness of the cold rolled steel sheet before hot stamping. n20 represents the number density (average number density) of MnS having an equivalent circle diameter in a range of 0.1 μm to 10 μm per unit area at the center portion of the sheet thickness of the cold rolled steel sheet before hot stamping.

In addition, the inventors observed MnS at the quarter thickness-deep position (a location quarter the sheet thickness deep from the surface) and center portion of the sheet thickness of the cold rolled steel sheet after hot stamping according to the embodiment. As a result, it was found that, similarly to the cold rolled steel sheet before hot stamping, the area ratio of MnS having an equivalent circle diameter in a range of 0.1 μm to 10 μm was 0.01% or less, and, as illustrated in FIG. 3, it is preferable to satisfy the following formula 4b in order to satisfy TS×λ≥50000 MPa·% favorably and stably.

$$n2/n1<1.5 \quad (4b)$$

Here, n1 represents the number density of MnS having an equivalent circle diameter in a range of 0.1 μm to 10 μm per unit area at the ¼ part of the sheet thickness of the cold rolled steel sheet after hot stamping. n2 represents the number density (average number density) of MnS having an equivalent circle diameter in a range of 0.1 μm to 10 μm per unit area at the center portion of the sheet thickness of the cold rolled steel sheet after hot stamping.

When the area ratio of MnS having an equivalent circle diameter in a range of 0.1 μm to 10 μm is more than 0.01%, as described above, formability is likely to degrade due to stress concentration. The lower limit of the area ratio of MnS is not particularly specified, but 0.0001% or more of MnS may be present due to the limitation of the below-described measurement method, magnification and visual field, desulfurization treatment capability and the original amount of Mn or S.

On the other hand, the value of n20/n10 or n2/n1 being 1.5 or more indicates that the number density of MnS at the center portion of the sheet thickness in the cold rolled steel sheet before hot stamping or the rolled steel sheet after hot stamping is 1.5 times or more the number density of MnS at the ¼ part of the sheet thickness. In this case, formability is likely to degrade due to the segregation of MnS at the center portion of the sheet thickness.

In the embodiment, the equivalent circle diameter and number density of MnS were measured using a field emission scanning electron microscope (Fe-SEM) manufactured by JEOL Ltd. The magnification was 1000 times, and the measurement area of the visual field was set to 0.12×0.09 $mm^2$ (=10800 $\mu m^2$≈10000 $\mu m^2$). The observation was carried out at 10 visual fields at the location quarter the sheet thickness deep from the surface (the ¼ part of the sheet thickness) and at 10 visual fields at the center portion of the sheet thickness. The area ratio of MnS was computed using particle analysis software. In the embodiment, MnS was observed in the cold rolled steel sheet before hot stamping and the cold rolled steel sheet after hot stamping, the form of MnS in the cold rolled steel sheet after hot stamping rarely changed from the form (shape and number) of MnS in the cold rolled steel sheet before hot stamping. FIG. 3 is a view illustrating the relationship between n20/n10 of the cold rolled steel sheet before hot stamping and n2/n1 of the cold rolled steel sheet after hot stamping and TS×λ. It is found that n20/n10 of the cold rolled steel sheet before hot stamping and n2/n1 of the cold rolled steel sheet after hot stamping are almost coincident. This is because the form of MnS does not change at the heating temperature of ordinary hot stamping.

The cold rolled steel sheet according to the embodiment has excellent formability. Furthermore, a cold rolled steel sheet after hot stamping obtained by carrying out hot stamping on the above-described cold rolled steel sheet has a tensile strength in a range of 1500 MPa (1.5 GPa) to 2200 MPa, and exhibits excellent formability. A significant effect that improves the formability compared with that of the cold rolled steel sheet of the related art is obtained particularly at a high strength in a range of approximately 1800 MPa to 2000 MPa.

It is preferable to carry out galvanizing, for example, hot dip galvanizing, galvannealing, electrogalvanizing or aluminizing on the surfaces of the cold rolled steel sheet according to the embodiment and the cold rolled steel sheet after hot stamping according to the embodiment in terms of rust prevention. Carrying out the above-described plating does not impair the effects of the embodiment. The above-described plating can be carried out using a well-known method.

Hereinafter, a manufacturing method of manufacturing the cold rolled steel sheet according to the embodiment will be described.

When manufacturing the cold rolled steel sheet according to the embodiment, as an ordinary condition, molten steel melted so as to have the above-described chemical components is continuously cast after a converter, thereby producing a slab. During the continuous casting, when the casting speed is too fast, precipitates of Ti and the like become too fine. On the other hand, when the casting speed is slow, the productivity deteriorates, and the above-described precipitates coarsen and the number of particles decreases such that there is a case in which the cold rolled steel sheet obtains a form in which other characteristics and thus delayed fracture cannot be controlled. Therefore, the casting speed is desirably set in a range of 1.0 m/minute to 2.5 m/minute.

The slab after melting and casting can be subjected to hot rolling as cast. Alternatively, in a case in which the slab has been cooled to lower than 1100° C., it is possible to reheat the slab in a tunnel furnace or the like at a temperature in a range of 1100° C. to 1300° C. and then hot-roll the slab. When the temperature of the slab during hot rolling is lower than 1100° C., it is difficult to ensure the finishing temperature during the hot rolling, which causes the degradation of elongation. In addition, in a steel sheet to which TiNb is added, precipitates are not sufficiently dissolved during heating, and therefore the strength decreases. On the other hand, when the temperature of the slab is higher than 1300° C., there is a concern that a number of scales may be generated and it may be impossible to obtain favorable surface quality of the steel sheet.

In addition, to decrease the area ratio of MnS, when the amount of Mn (mass %) and the amount of S (mass %) of steel are respectively represented by [Mn] and [S], it is preferable for the temperature T (° C.) of the heating furnace, the in-furnace time t (minutes), [Mn] and [S] before the hot rolling to satisfy the following formula 7.

$$T\times\ln(t)/(1.7\times[Mn]+[S])>1500 \quad (7)$$

When the value of T×ln(t)/(1.7×[Mn]+[S]) is 1500 or less, the area ratio of MnS becomes large, and there is a case in which the difference becomes large between the number of MnS at the ¼ part of the sheet thickness and the number of MnS at the center portion of the sheet thickness. Meanwhile, the temperature of the heating furnace before the hot rolling refers to the extraction temperature on the outlet side of the heating furnace, and the in-furnace time refers to the time elapsed from the insertion of the slab into the hot rolling heating furnace to the extraction of the slab from the heating furnace. Since MnS does not change due to rolling or hot stamping as described above, the formula 7 is preferably satisfied during the heating of the slab. Meanwhile, the above-described ln represents a natural logarithm.

Next, hot rolling is carried out according to a conventional method. At this time, it is desirable to carry out hot rolling on the slab with the finishing temperature (the temperature when the hot rolling ends) set in a range of Ar3 temperature to 970° C. When the finishing temperature is lower than Ar3 temperature, there is a concern that rolling may be carried out in a two-phase region of ferrite (α) and austenite (γ) and the elongation may degrade. On the other hand, when the finishing temperature is higher than 970° C., the austenite grain size coarsens, and the fraction of ferrite becomes small, and therefore there is a concern that the elongation may degrade.

The Ar3 temperature can be obtained by carrying out a formastor test, measuring the change in the length of a test specimen in response to the temperature change, and estimating the temperature from the inflection point.

After the hot rolling, the steel is cooled at an average cooling rate in a range of 20° C./second to 500° C./second, and is coiled at a predetermined coiling temperature CT° C. In a case in which the cooling rate is less than 20° C./second, pearlite causing the degradation of the elongation is likely to be generated, which is not preferable.

On the other hand, the upper limit of the cooling rate is not particularly specified, but the upper limit of the cooling rate is desirably set to approximately 500° C./second from the viewpoint of the facility specification, but the upper limit is not limited thereto.

Figure 4:
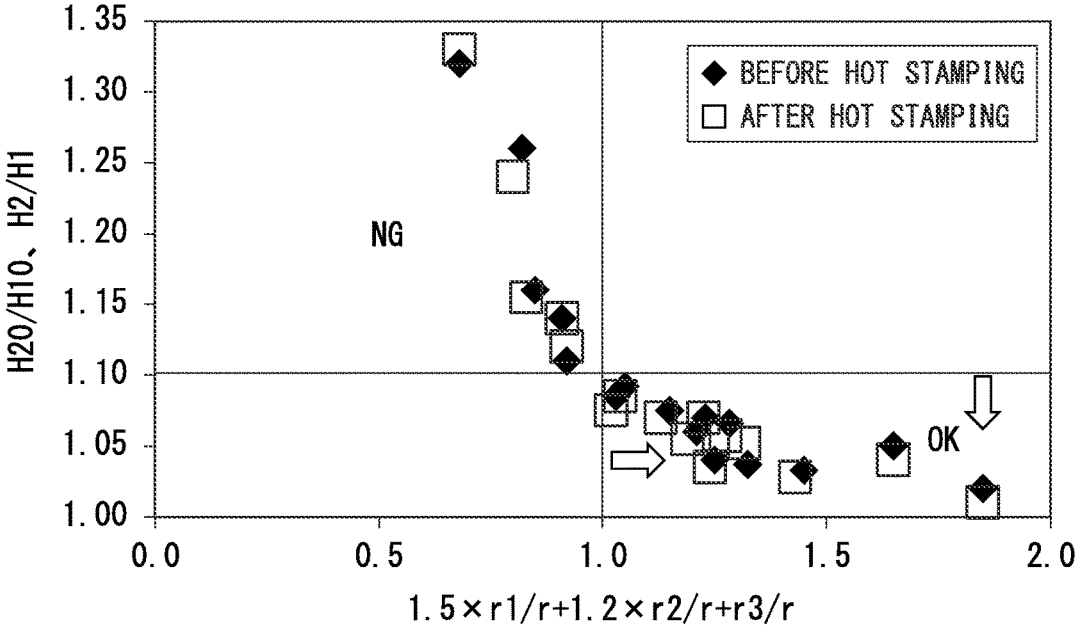
FIG. 4 is a graph illustrating a relationship between 1.5×r1/r+1.2×r2/2+r3/r, and H20/H10 of the cold rolled steel sheet before hot stamping and H2/H1 after hot stamping, and illustrating the foundation of Formula 5.

After the coiling, pickling is carried out, and cold rolling is carried out. At this time, as illustrated in FIG. 4, the cold rolling is carried out under conditions in which the following formula 5 is satisfied to obtain a range satisfying the above-described formula 2a. When the below-described conditions of annealing, cooling and the like are further satisfied after the above-described rolling is carried out, a cold rolled steel sheet in which TS×λ≥50000 MPa·% is satisfied is obtained. In addition, the cold rolled steel sheet still satisfies TS×λ≥50000 MPa·% even after hot stamping including heating at a temperature in a range of 750° C. to 1000° C., working and cooling are carried out. The cold rolling is desirably carried out using a tandem rolling mill in which a steel sheet is continuously rolled in a single direction through a plurality of linearly-disposed rolling mills, thereby obtaining a predetermined thickness.

$$1.5\times r1/r+1.2\times r2/r+r3/r>1.0 \quad (5)$$

Here, ri (i=1, 2 or 3) represents the individual target cold rolling reduction (%) in the $i^{th}$ (i=1, 2 or 3) stand from the uppermost stand in the above-described cold rolling, and r represents the total cold rolling reduction (%) in the above-described cold rolling. The total rolling reduction is a so-called cumulative rolling reduction, and is the percentage of the cumulative rolling reduction amount with respect to the criterion of the sheet thickness at the inlet of the first pass (the difference between the sheet thickness at the inlet before the first pass and the sheet thickness at the outlet after the final pass).

When cold rolling is carried out under conditions in which the above-described formula 5 is satisfied, it is possible to sufficiently divide pearlite during the cold rolling even when large pearlite is present before the cold rolling. As a result, it is possible to burn the pearlite or suppress the area ratio of the pearlite to the minimum extent through annealing carried out after the cold rolling. Therefore, it becomes easy to obtain a structure in which the formulae 2 and 3 are satisfied. On the other hand, in a case in which the formula 5 is not satisfied, the cold rolling reduction s in the upper stream stands are not sufficient, and large pearlite is likely to remain. As a result, it is not possible to generate martensite having a desired form in the annealing process.

In addition, the inventors found that, in the cold rolled steel sheet that had been subjected to rolling satisfying the formula 5, it was possible to maintain the form of the martensite obtained after annealing (hardness ratio and variance) in almost the same state even after carrying out hot stamping, and the cold rolled steel sheet became advantageous in terms of elongation or hole expansibility even after hot stamping. In a case in which the cold rolled steel sheet according to the embodiment is heated up to an austenite region through hot stamping, the hard phase including the martensite turns into an austenite having a high C concentration, and the ferrite phase turns into the austenite having a low C concentration. When the cold rolled steel sheet is cooled afterwards, the austenite turns into a hard phase including martensite. That is, when the formula 5 is satisfied so as to obtain the above-described H20/H10 in a predetermined range, the H20/H10 is maintained even after hot stamping, and thereby H2/H1 is obtained in a predetermined range, and the cold rolled steel sheet becomes excellent in terms of formability after hot stamping.

In a case in which hot stamping is carried out on the cold rolled steel sheet according to the embodiment, when heating at a temperature in a range of 750° C. to 1000° C., working and cooling are carried out according to a conventional method, excellent formability is exhibited even after hot stamping. For example, hot stamping is desirably carried out under the following conditions. First, the cold rolled steel sheet is heated to a temperature in a range of 750° C. to 1000° C. at a temperature-increase rate of 5° C./second to 500° C./second, and is worked (formed) for one second to 120 seconds. To obtain high strength, the heating temperature is preferably higher than the Ac3 point. The Ac3 point may be obtained by carrying out a formastor test, measuring the change in the length of a test specimen in response to the temperature change, and estimating the temperature from the inflection point. After the working, the cold rolled steel sheet is preferably cooled to, for example, a temperature in a range of room temperature to 300° C. at a cooling rate of 10° C./second to 1000° C./second.

When the heating temperature is lower than 750° C. the fraction of martensite is insufficient, and there is a concern that it may be impossible to ensure strength. On the other hand, when the heating temperature is higher than 1000° C., the structure becomes too soft, and, in a case in which the surface of the steel sheet is plated, particularly, is plated with zinc, there is a concern that zinc may be evaporated and burned, which is not preferable. Therefore, the heating temperature of hot stamping is preferably in a range of 750° C. to 1000° C. When the temperature-increase rate is less than 5° C./second, the control is difficult and the productivity is significantly degraded, and therefore the cold rolled steel sheet is preferably heated at a temperature-increase rate of 5° C./second or more. Meanwhile, there is no need to limit the upper limit of the temperature-increase rate; however, when the current heating capability is taken into account, the upper limit of the temperature-increase rate is desirably set to 500° C./second. When the cooling rate after working is less than 10° C./second, the speed control is difficult, and the productivity is significantly degraded. Meanwhile, there is no need to limit the upper limit of the cooling rate; however, when the current cooling capability is taken into account, the upper limit of the cooling rate is desirably set to 1000° C./second. The reason for setting a desirable time elapsed until the hot stamping after the temperature increase in a range of 1 second to 120 seconds is to avoid the evaporation of the zinc or the like in a case in which the surface of the steel sheet is galvanized or the like. The reason for a desirable cooling stop temperature in a range of room temperature to 300° C. is to ensure strength after hot stamping by ensuring a sufficient amount of martensite.

In the embodiment, r, r1, r2 and r3 represent target cold rolling reductions. Generally, a steel sheet is cold-rolled with a control so as to obtain almost the same value of the actual cold rolling reduction as the target cold rolling reduction. It is not preferable to carry out cold rolling with an actual cold rolling reduction unnecessarily deviated from the target cold rolling reduction. In a case in which there is a large difference between the target rolling reduction and the actual rolling reduction, it is possible to consider that a cold rolled steel sheet is an embodiment of the present invention as long as the actual rolling reduction satisfies the above-described formula 5. The actual cold rolling reduction is preferably converged within a ±10% range of the target cold rolling reduction.

After the cold rolling, annealing is carried out. Annealing causes recrystallization in the steel sheet, and generates desired martensite. During the annealing, it is preferable to, according to a conventional method, heat the steel sheet to a temperature range of 700° C. to 850° C., and cool the steel sheet to room temperature or a temperature at which a surface treatment such as hot dip galvanizing is carried out. When the annealing is carried out in the above-described temperature range, predetermined area ratios of ferrite and martensite are obtained, and the sum of the ferrite area ratio and the martensite area ratio reaches 60% or more, and therefore TS×λ improves.

Conditions other than the annealing temperature are not particularly specified; however, to reliably ensure a predetermined structure, the holding time at a temperature in a range of 700° C. to 850° C. is preferably set to 1 second or more, for example, approximately 10 minutes within the scope in which the productivity is not impaired. The temperature-increase rate is preferably determined as appropriate in a range of 1° C./second to the facility capacity upper limit, for example, 500° C./second, and the cooling rate is preferably determined as appropriate in a range of 1° C./second to the facility capacity upper limit, for example, 500° C./second After the annealing, temper rolling is carried out on the steel. Temper rolling can be carried out according to a conventional method. The elongation ratio of the temper rolling is generally in a range of approximately 0.2% to 5%, and an elongation ratio at which the yield point elongation can be avoided and the shape of the steel sheet can be corrected is preferable.

As a still more preferable condition of the present invention, when the amount of C (mass %), the amount of Mn (mass %), the amount of Si (mass %) and the amount of Mo (mass %) of steel are respectively represented by [C], [Mn], [Si] and [Mo], the coiling temperature CT in the coiling process preferably satisfies the following formula 6.

$$560-474\times[C]-90\times[Mn]-20\times[Cr]-20\times[Mo]<CT<830-270\times[C]-90\times[Mn]-70\times[Cr]-80\times[Mo] \quad (6)$$

Figure 5A:
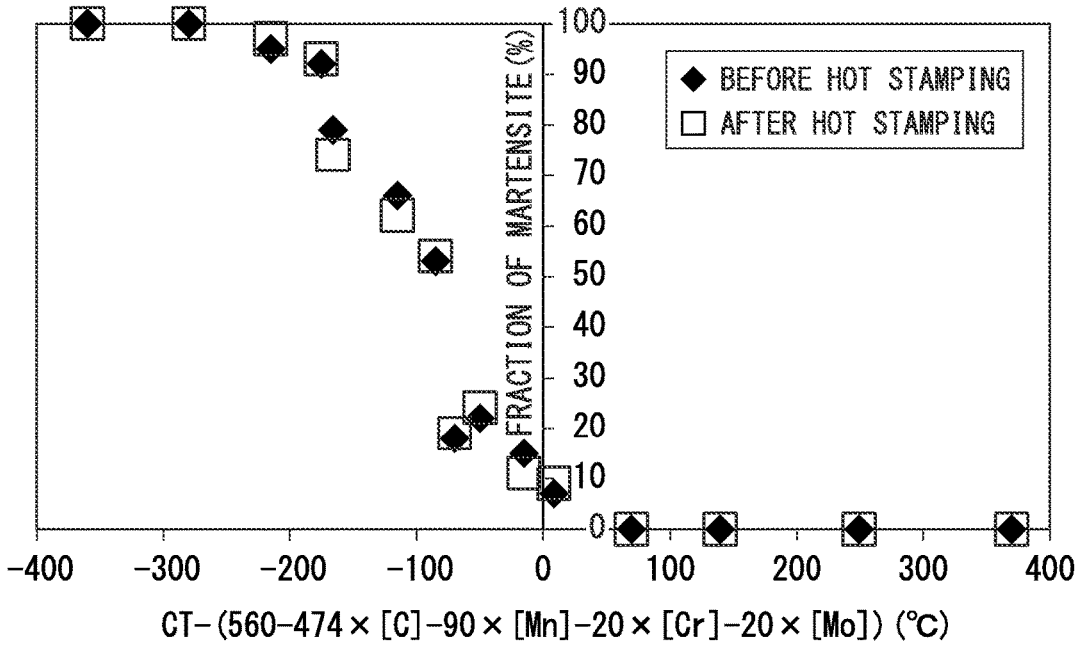
FIG. 5A is a graph illustrating a relationship between Formula 6 and a fraction of martensite.
Figure 5B:
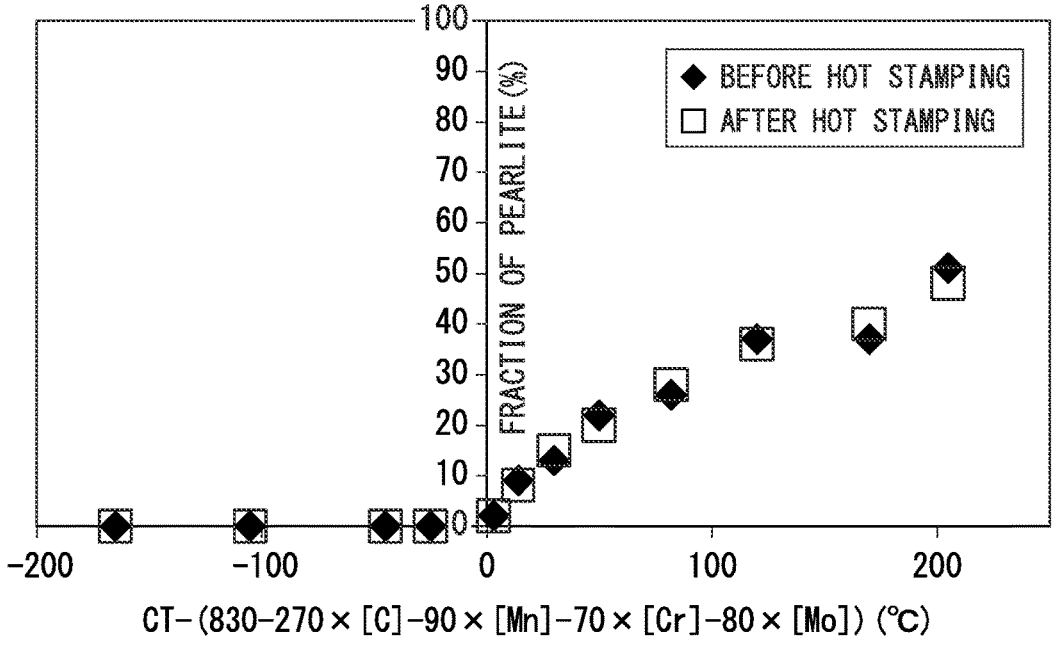
FIG. 5B is a graph illustrating a relationship between Formula 6 and a fraction of pearlite.
Figure 6:
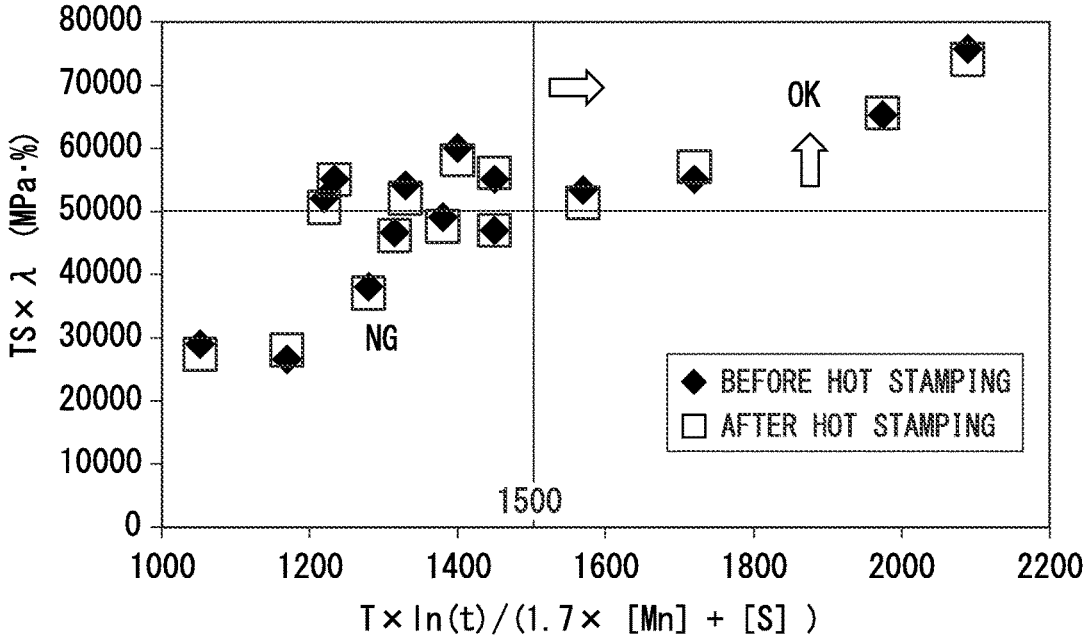
FIG. 6 is a graph illustrating a relationship between T×ln(t)/(1.7×[Mn]+[S]) and TS×λ, and illustrating the foundation of Formula 7.

As illustrated in FIG. 5A, when the coiling temperature CT is less than 560-474× [C]−90×[Mn]−20× [Cr]—20× [Mo], that is, CT-560-474× [C]−90× [Mn]−20×[Cr]−20× [Mo] is less than zero, an excessive amount of martensite is generated, and the steel sheet becomes too hard such that there is a case in which the subsequent cold rolling becomes difficult. On the other hand, as illustrated in FIG. 5B, when the coiling temperature CT is more than 830-270× [C]−90× [Mn]−70× [Cr]−80× [Mo], that is, CT-830-270×[C]−90× [Mn]−70× [Cr]−80× [Mo] is more than zero, it becomes likely that a band-like structure including ferrite and pearlite is generated. In addition, the fraction of pearlite at the center portion of the sheet thickness is likely to become high. Therefore, the uniformity of the distribution of martensite being generated during the subsequent annealing process degrades, and it becomes difficult to satisfy the above-described formula 2a. In addition, there is a case in which it becomes difficult for a sufficient amount of martensite to be generated.

When the formula 6 is satisfied, a distribution of the ferrite and the hard phase become ideal form in the cold rolled steel sheet before hot stamping as described above. Furthermore, in this case, C and the like easily diffuse in a uniform manner even after heating and cooling through hot stamping. Therefore, the distribution form of the hardness of martensite becomes approximately ideal even after cooling is carried out. That is, as long as it is possible to more reliably ensure the above-described metallographic structure by satisfying the formula 6, formability becomes excellent in both cases of before and after hot stamping.

Furthermore, for the purpose of improving the rust-preventing capability, it is preferable to provide a hot dip galvanizing process in which hot dip galvanizing is carried out between the above-described annealing process and the above-described temper rolling process, and to carry out the hot dip galvanizing process on the surface of the cold rolled steel sheet. Furthermore, it is also preferable to provide an alloying treatment process in which an alloying treatment is carried out between the hot dip galvanizing process and the temper rolling process to obtain a galvannealed plate by alloying a hot dip galvanized plate. In a case in which an alloying treatment is carried out, a treatment may be further carried out on the surface of the galvannealed plate in which the surface is brought into contact with a substance oxidizing the surface of the plate such as water vapor, thereby thickening an oxidized film.

It is also preferable to provide, for example, an electrogalvanizing process in which electrogalvanizing is carried out on the surface of the cold rolled steel sheet after the temper rolling process in addition to the hot dip galvanizing process and the alloying treatment process. In addition, it is also preferable to provide, instead of the hot dip galvanizing, an aluminizing process in which aluminizing is carried out between the annealing process and the temper rolling process, and to carry out aluminizing on the surface of the cold rolled steel sheet. Aluminizing is generally and preferably hot dip aluminum plating.

As described above, when the above-described conditions are satisfied, it is possible to manufacture a cold rolled steel sheet that ensures strength and exhibits more favorable hole expansibility. Furthermore, the hardness distribution or the structure is maintained even after hot stamping so that strength is ensured and more favorable hole expansibility is obtained even after hot stamping.

Figure 8:
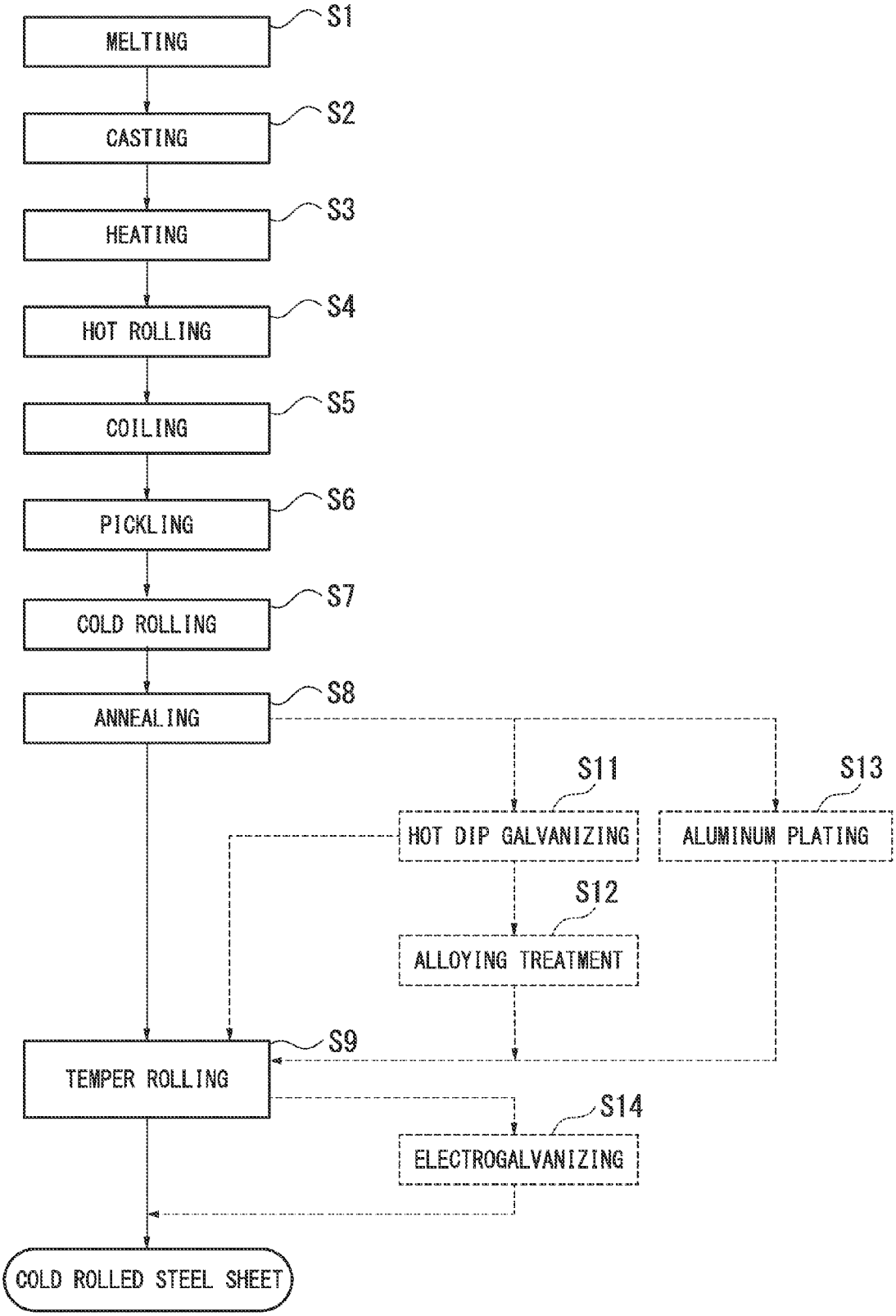
FIG. 8 is a flowchart illustrating a manufacturing method of manufacturing a cold rolled steel sheet according to an embodiment of the present invention.

Meanwhile, FIG. 8 illustrates a flowchart (Processes S1 to S9 and Processes Processes S11 to S14) of an example of the manufacturing method described above.

Example

Figure 7:
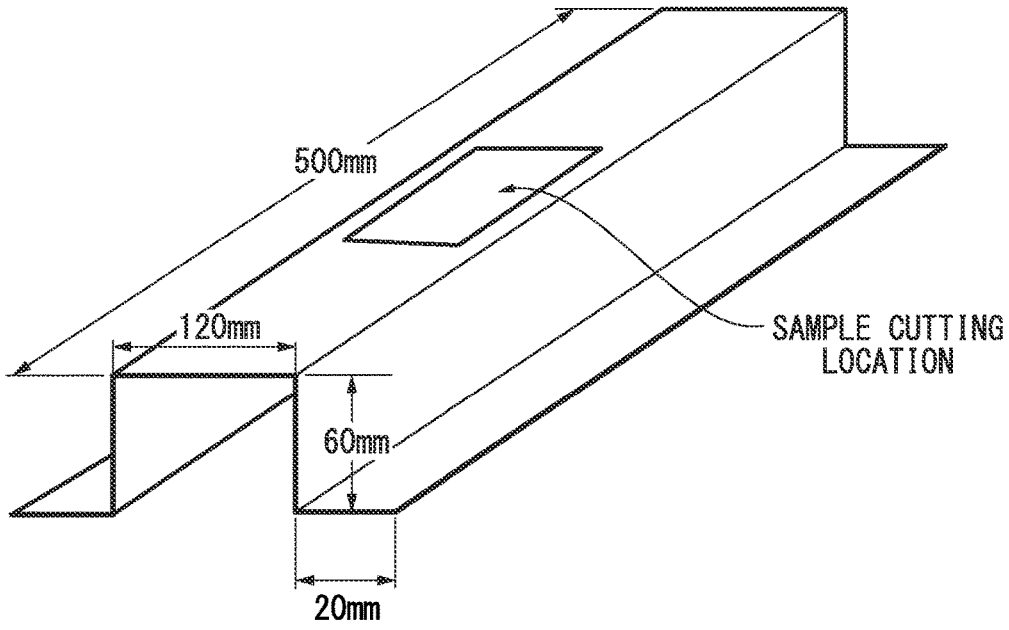
FIG. 7 is a perspective view of a hot stamped steel (cold rolled steel sheet after hot stamping) used in an example.

Steel having the components described in Table 1 was continuously cast at a casting rate in a range of 1.0 m/minute to 2.5 m/minute, a slab was heated in a heating furnace under the conditions of Table 2 according to a conventional method as cast or after cooling the steel once, and hot rolling was carried out at a finishing temperature in a range of 910° C. to 930° C., thereby producing a hot rolled steel sheet. After that, the hot rolled steel sheet was coiled at a coiling temperature CT described in Table 2. After that, scales on the surface of the steel sheet were removed by carrying out pickling, and a sheet thickness in a range of 1.2 mm to 1.4 mm was obtained through cold rolling. At this time, the cold rolling was carried out so that the value of the formula 5 became the value described in Table 2. After the cold rolling, annealing was carried out in a continuous annealing furnace at the annealing temperature described in Tables 3 and 4. On some of the steel sheets, hot dip galvanizing was carried out in the middle of cooling after soaking in the continuous annealing furnace, and then an alloying treatment was further carried out on some of the hot dip-galvanized steel sheets, thereby carrying out galvannealing. In addition, electrogalvanizing or aluminizing was carried out on some of the steel sheets. Temper rolling was carried out at an elongation ratio of 1% according to a conventional method. In this state, a sample was taken to evaluate the material qualities of the cold rolled steel sheet (before hot stamping), and a material quality test or the like was carried out. After that, to investigate the characteristics of the cold rolled steel sheet after hot stamping, hot stamping was carried out in which the cold rolled steel sheet was heated at a temperature-increase rate in a range of 10° C./second to 100° C./second to the thermal treatment temperature of Tables 5 and 6, held for 10 seconds, and cooled to 200° C. or lower at a cooling rate of 100° C./second, thereby obtaining a hot stamped steel having a form as illustrated in FIG. 7. A sample was cut from a location in the obtained hot stamped steel illustrated in FIG. 7, a material quality test and a structure observation were carried out, and the fractions of the respective structures, the number density of MnS, hardness, tensile strength (TS), elongation (El), hole expansion ratio (λ) were obtained. The results are described in Tables 3 to 8. The hole expansion ratios λ in Tables 3 to 6 were obtained using the following formula 11.

$$\lambda(\%)=\{(d'-d)/d\}\times 100 \quad \text{(Formula 11)}$$

d': hole diameter when cracks penetrate the sheet d: the initial hole diameter

Regarding the plating types in Tables 5 and 6, CR represents a non-plated cold rolled steel sheet. GI represents a hot dip galvanized cold rolled steel sheet, GA represents a galvannealed cold rolled steel sheet, EG represents an electrogalvanized cold rolled steel sheet, and Al represents an aluminizing cold rolled steel sheet.

The amount of "0" in Table 1 indicates that the amount is equal to or smaller than the measurement lower limit.

The determinations G and B in Tables 2, 7 and 8 respectively have the following meanings.

G: the target condition formula is satisfied.

B: the target condition formula is not satisfied.

TABLE 1

(mass %)

| Steel Type reference symbol | C | Si | Mn | P | S | N | Al | Cr | Mo | V | Ti | Nb | Ni | Cu | Ca | B | REM | Formula 1 | Note |
|---|---|---|---|---|---|---|---|---|---|---|---|---|---|---|---|---|---|---|---|
| A | 0.151 | 0.145 | 2.01 | 0.003 | 0.008 | 0.0035 | 0.035 | 0 | 0 | 0 | 0 | 0 | 0 | 0 | 0 | 0 | 0 | 18 | Invention components |
| B | 0.158 | 0.231 | 1.61 | 0.023 | 0.006 | 0.0064 | 0.021 | 0 | 0 | 0 | 0 | 0 | 0.3 | 0 | 0 | 0 | 0 | 18 | Invention components |
| C | 0.167 | 0.950 | 2.12 | 0.008 | 0.009 | 0.0034 | 0.042 | 0.12 | 0 | 0 | 0 | 0 | 0 | 0 | 0 | 0 | 0 | 41 | Invention components |
| D | 0.178 | 0.342 | 1.62 | 0.007 | 0.007 | 0.0035 | 0.042 | 0.42 | 0.15 | 0 | 0 | 0 | 0 | 0 | 0 | 0 | 0 | 19 | Invention components |
| E | 0.186 | 0.251 | 1.89 | 0.008 | 0.008 | 0.0045 | 0.034 | 0.21 | 0 | 0 | 0 | 0 | 0 | 0 | 0 | 0 | 0 | 17 | Invention components |
| F | 0.191 | 0.256 | 1.71 | 0.006 | 0.009 | 0.0087 | 0.041 | 0 | 0 | 0 | 0 | 0 | 0 | 0.4 | 0.004 | 0 | 0 | 16 | Invention components |
| G | 0.197 | 0.321 | 1.51 | 0.012 | 0.008 | 0.0041 | 0.038 | 0 | 0 | 0 | 0 | 0 | 0 | 0 | 0 | 0 | 0 | 16 | Invention components |
| H | 0.206 | 0.465 | 1.52 | 0.051 | 0.001 | 0.0035 | 0.032 | 0.32 | 0.05 | 0 | 0 | 0 | 0 | 0 | 0.003 | 0 | 0 | 19 | Invention components |
| I | 0.214 | 0.512 | 2.05 | 0.008 | 0.002 | 0.0035 | 0.041 | 0 | 0 | 0.03 | 0 | 0 | 0 | 0 | 0 | 0 | 0 | 22 | Invention components |
| J | 0.216 | 0.785 | 1.62 | 0.007 | 0.009 | 0.0014 | 0.045 | 0 | 0.00 | 0 | 0 | 0 | 0 | 0 | 0 | 0.0008 | 0 | 26 | Invention components |
| K | 0.222 | 0.412 | 1.74 | 0.006 | 0.008 | 0.0026 | 0.034 | 0 | 0 | 0 | 0 | 0 | 0 | 0 | 0 | 0 | 0 | 18 | Invention components |
| L | 0.227 | 0.624 | 2.11 | 0.012 | 0.006 | 0.0015 | 0.012 | 0 | 0.21 | 0 | 0.05 | 0 | 0 | 0 | 0 | 0 | 0 | 24 | Invention components |
| M | 0.231 | 0.325 | 1.58 | 0.011 | 0.005 | 0.0032 | 0.025 | 0 | 0 | 0 | 0 | 0 | 0 | 0 | 0 | 0 | 0 | 14 | Invention components |
| N | 0.236 | 0.265 | 2.61 | 0.009 | 0.008 | 0.0035 | 0.041 | 0 | 0.31 | 0 | 0 | 0 | 0 | 0 | 0 | 0.0012 | 0 | 17 | Invention components |
| O | 0.241 | 0.955 | 1.74 | 0.007 | 0.007 | 0.0041 | 0.037 | 0 | 0.25 | 0 | 0 | 0 | 0 | 0 | 0 | 0 | 0 | 28 | Invention components |
| P | 0.245 | 0.210 | 2.45 | 0.005 | 0.008 | 0.0022 | 0.012 | 0.42 | 0 | 0 | 0 | 0 | 0 | 0 | 0 | 0 | 0 | 15 | Invention components |
| Q | 0.251 | 0.325 | 1.84 | 0.011 | 0.003 | 0.0041 | 0.035 | 0 | 0.11 | 0 | 0 | 0.01 | 0 | 0 | 0 | 0.0010 | 0 | 14 | Invention components |
| R | 0.256 | 0.120 | 2.06 | 0.008 | 0.004 | 0.0047 | 0.035 | 0 | 0 | 0 | 0 | 0.03 | 0 | 0 | 0 | 0 | 0 | 11 | Invention components |
| S | 0.264 | 0.562 | 1.86 | 0.013 | 0.007 | 0.0034 | 0.015 | 0 | 0.12 | 0 | 0 | 0 | 0 | 0 | 0 | 0 | 0 | 18 | Invention components |
| T | 0.271 | 0.150 | 2.01 | 0.018 | 0.003 | 0.0031 | 0.031 | 0 | 0.21 | 0 | 0.03 | 0 | 0 | 0 | 0 | 0 | 0 | 10 | Invention components |
| U | 0.278 | 0.115 | 2.41 | 0.011 | 0.003 | 0.0060 | 0.021 | 0 | 0.31 | 0 | 0 | 0 | 0 | 0 | 0 | 0.0008 | 0 | 11 | Invention components |
| W | 0.281 | 0.562 | 2.03 | 0.012 | 0.007 | 0.0012 | 0.036 | 0 | 0 | 0 | 0 | 0 | 0 | 0 | 0.002 | 0 | 0 | 17 | Invention components |
| X | 0.289 | 0.921 | 1.54 | 0.013 | 0.003 | 0.0087 | 0.026 | 0.15 | 0.11 | 0 | 0.05 | 0 | 0 | 0 | 0 | 0.0014 | 0.0005 | 22 | Invention components |
| Y | 0.293 | 0.150 | 2.44 | 0.009 | 0.007 | 0.0074 | 0.034 | 0.32 | 0 | 0 | 0 | 0 | 0 | 0 | 0 | 0.0015 | 0 | 11 | Invention components |
| Z | 0.298 | 0.352 | 2.00 | 0.008 | 0.004 | 0.0069 | 0.035 | 0 | 0.15 | 0.05 | 0 | 0 | 0 | 0 | 0 | 0 | 0 | 13 | Invention components |
| AA | 0.175 | 0.210 | 1.85 | 0.010 | 0.005 | 0.0025 | 0.025 | 0 | 0 | 0 | 0 | 0 | 0 | 0 | 0 | 0 | 0 | 17 | Invention components |
| AB | 0.185 | 0.210 | 1.84 | 0.011 | 0.005 | 0.0032 | 0.032 | 0 | 0 | 0 | 0 | 0 | 0 | 0 | 0 | 0.0008 | 0 | 16 | Invention components |
| AC | 0.192 | 0.150 | 1.95 | 0.008 | 0.003 | 0.0035 | 0.035 | 0 | 0 | 0 | 0 | 0 | 0 | 0 | 0 | 0.0011 | 0 | 14 | Invention components |
| AD | 0.175 | 0.325 | 1.95 | 0.008 | 0.004 | 0.0034 | 0.031 | 0 | 0.15 | 0 | 0 | 0 | 0 | 0 | 0 | 0 | 0 | 20 | Invention components |
| AE | 0.187 | 0.256 | 1.99 | 0.008 | 0.002 | 0.0030 | 0.031 | 0 | 0 | 0 | 0 | 0.01 | 0 | 0 | 0 | 0.0015 | 0 | 17 | Invention components |
| AF | 0.192 | 0.263 | 1.85 | 0.008 | 0.002 | 0.0030 | 0.031 | 0 | 0 | 0 | 0 | 0 | 0 | 0 | 0 | 0 | 0 | 16 | Invention components |
| AG | 0.154 | 0.526 | 1.85 | 0.007 | 0.003 | 0.0034 | 0.030 | 0 | 0 | 0 | 0 | 0 | 0 | 0 | 0 | 0 | 0 | 29 | Invention components |
| AH | 0.120 | 0.320 | 1.65 | 0.007 | 0.003 | 0.0035 | 0.035 | 0 | 0 | 0 | 0 | 0 | 0 | 0 | 0 | 0 | 0.0006 | 27 | Comparative components |
| AI | 0.321 | 0.489 | 2.04 | 0.003 | 0.006 | 0.0009 | 0.041 | 0 | 0 | 0 | 0 | 0 | 0 | 0 | 0 | 0 | 0 | 14 | Comparative components |
| AJ | 0.174 | 0.005 | 2.22 | 0.007 | 0.009 | 0.0035 | 0.035 | 0 | 0.15 | 0 | 0 | 0 | 0 | 0 | 0 | 0.0012 | 0 | 13 | Comparative components |
| AK | 0.189 | 1.151 | 1.50 | 0.008 | 0.005 | 0.0034 | 0.026 | 0.280 | 0.32 | 0 | 0 | 0 | 0 | 0 | 0 | 0.0015 | 0 | 38 | Comparative components |
| AL | 0.210 | 0.660 | 1.21 | 0.009 | 0.003 | 0.0032 | 0.029 | 0 | 0 | 0 | 0 | 0 | 0 | 0 | 0 | 0.0000 | 0 | 21 | Comparative components |
| AM | 0.254 | 0.050 | 2.91 | 0.007 | 0.004 | 0.0034 | 0.036 | 0 | 0 | 0 | 0 | 0 | 0 | 0 | 0 | 0 | 0 | 12 | Comparative components |
| AN | 0.263 | 0.321 | 2.05 | 0.091 | 0.003 | 0.0021 | 0.034 | 0.256 | 0.15 | 0 | 0 | 0.03 | 0 | 0 | 0 | 0 | 0 | 14 | Comparative components |
| AO | 0.275 | 0.154 | 2.50 | 0.002 | 0.025 | 0.0059 | 0.034 | 0 | 0 | 0 | 0 | 0 | 0.2 | 0 | 0 | 0 | 0 | 12 | Comparative components |
| AP | 0.245 | 0.256 | 1.52 | 0.011 | 0.009 | 0.0145 | 0.026 | 0 | 0 | 0 | 0 | 0.02 | 0 | 0 | 0.003 | 0 | 0 | 11 | Comparative components |
| AQ | 0.174 | 0.012 | 2.25 | 0.006 | 0.004 | 0.0058 | 0.003 | 0 | 0.20 | 0 | 0 | 0 | 0 | 0 | 0 | 0 | 0 | 13 | Comparative components |
| AR | 0.281 | 0.150 | 2.35 | 0.005 | 0.003 | 0.0035 | 0.074 | 0 | 0.22 | 0 | 0 | 0 | 0 | 0 | 0 | 0 | 0 | 11 | Comparative components |
| AS | 0.291 | 0.020 | 1.54 | 0.007 | 0.003 | 0.0032 | 0.031 | 0 | 0 | 0 | 0 | 0 | 0 | 0 | 0 | 0.001 | 0 | 6 | Comparative components |
| AT | 0.294 | 0.315 | 1.95 | 0.005 | 0.003 | 0.0020 | 0.025 | 0 | 0 | 0 | 0 | 0.01 | 0 | 0 | 0 | 0 | 0 | 12 | Invention components |
| AU | 0.274 | 0.220 | 1.84 | 0.005 | 0.003 | 0.0020 | 0.025 | 0 | 0 | 0 | 0.01 | 0 | 0 | 0 | 0 | 0 | 0 | 11 | Invention components |
| AV | 0.277 | 0.201 | 1.61 | 0.018 | 0.003 | 0.0031 | 0.031 | 0 | 0 | 0 | 0.01 | 0 | 0 | 0 | 0 | 0 | 0 | 9 | Comparative components |

TABLE 2

| Test reference symbol | Heating furnace temperature (° C.) | Heating furnace in-furnace time (minutes) | Right side of Formula 7 | Determination | Left side of Formula 5 | Determination | Left side of Formula 6 | CT (° C.) | Right side of Formula 6 | Determination |
|---|---|---|---|---|---|---|---|---|---|---|
| 1 | 1200 | 121 | 1616 | G | 1.4 | G | 308 | 550 | 608 | G |
| 2 | 1111 | 39 | 1371 | B | 1.2 | G | 340 | 615 | 642 | G |
| 3 | 1285 | 205 | 1502 | G | 1.1 | G | 288 | 555 | 586 | G |
| 4 | 1156 | 124 | 1800 | G | 1.4 | G | 318 | 495 | 595 | G |
| 5 | 1222 | 136 | 1733 | G | 1.4 | G | 298 | 574 | 595 | G |
| 6 | 1232 | 127 | 1887 | G | 1.2 | G | 316 | 631 | 625 | B |
| 7 | 1256 | 111 | 2048 | G | 1.3 | G | 331 | 623 | 641 | G |
| 8 | 1256 | 106 | 1921 | G | 1.2 | G | 318 | 601 | 611 | G |
| 9 | 1250 | 205 | 1665 | G | 1.6 | G | 278 | 554 | 590 | G |
| 10 | 1206 | 87 | 1522 | G | 1.4 | G | 313 | 440 | 626 | G |
| 11 | 1214 | 152 | 1810 | G | 1.1 | G | 301 | 627 | 615 | B |
| 12 | 1233 | 182 | 1524 | G | 1.2 | G | 261 | 550 | 563 | G |
| 13 | 1198 | 132 | 1943 | G | 1.3 | G | 310 | 457 | 627 | G |
| 14 | 1287 | 252 | 1513 | G | 1.2 | G | 209 | 389 | 508 | G |
| 15 | 1105 | 201 | 1498 | B | 1.5 | G | 287 | 541 | 590 | G |
| 16 | 1285 | 222 | 1587 | G | 1.7 | G | 217 | 487 | 515 | G |
| 17 | 1156 | 135 | 1642 | G | 1.9 | G | 276 | 501 | 589 | G |
| 18 | 1200 | 185 | 1730 | G | 1.6 | G | 256 | 244 | 577 | B |
| 19 | 1232 | 122 | 1589 | G | 1.3 | G | 269 | 520 | 584 | G |
| 20 | 1256 | 152 | 1769 | G | 1.1 | G | 250 | 512 | 561 | G |
| 21 | 1256 | 155 | 1506 | G | 1.2 | G | 209 | 489 | 515 | G |
| 22 | 1250 | 145 | 1550 | G | 1.3 | G | 246 | 501 | 572 | G |
| 23 | 1150 | 138 | 1600 | G | 1.2 | G | 283 | 253 | 596 | B |
| 24 | 1260 | 182 | 1526 | G | 1.4 | G | 197 | 485 | 510 | G |
| 25 | 1146 | 114 | 1447 | B | 1.5 | G | 236 | 504 | 558 | G |
| 26 | 1200 | 132 | 1746 | G | 0.7 | B | 311 | 602 | 616 | G |
| 27 | 1194 | 71 | 1525 | G | 0.8 | B | 307 | 514 | 614 | G |
| 28 | 1163 | 96 | 1532 | G | 0.6 | B | 293 | 506 | 603 | G |
| 29 | 1200 | 145 | 1641 | G | 0.8 | B | 299 | 451 | 595 | G |
| 30 | 1155 | 152 | 1595 | G | 0.9 | B | 292 | 554 | 600 | G |
| 31 | 1187 | 75 | 1504 | G | 0.7 | B | 302 | 521 | 612 | G |
| 32 | 1215 | 152 | 1663 | G | 0.8 | B | 321 | 555 | 622 | G |
| 33 | 1241 | 132 | 1939 | G | 1.2 | G | 355 | 511 | 649 | G |
| 34 | 1250 | 178 | 1637 | G | 1.1 | G | 224 | 545 | 560 | G |
| 35 | 1205 | 111 | 1502 | G | 1.2 | G | 275 | 520 | 571 | G |
| 36 | 1156 | 127 | 1513 | G | 1.2 | G | 323 | 510 | 599 | G |
| 37 | 1109 | 45 | 1554 | G | 1.2 | G | 352 | 602 | 664 | G |
| 38 | 1295 | 336 | 1508 | G | 1.3 | G | 178 | 485 | 500 | G |
| 39 | 1212 | 124 | 1535 | G | 1.2 | G | 243 | 540 | 544 | G |
| 40 | 1297 | 164 | 1504 | G | 1.3 | G | 202 | 501 | 521 | G |
| 41 | 1312 | 132 | 2256 | G | 1.1 | G | 307 | 582 | 627 | G |
| 42 | 1241 | 162 | 1645 | G | 1.1 | G | 271 | 389 | 565 | G |
| 43 | 1254 | 222 | 1634 | G | 1.5 | G | 211 | 471 | 525 | G |
| 45 | 1278 | 205 | 2579 | G | 1.4 | G | 283 | 600 | 613 | G |
| 46 | 1199 | 210 | 1766 | G | 1.3 | G | 245 | 502 | 575 | G |
| 47 | 1185 | 202 | 1879 | G | 1.6 | G | 265 | 552 | 590 | G |
| 48 | 1194 | 202 | 2157 | G | 1.6 | G | 284 | 502 | 610 | G |

TABLE 3

| | | | After annealing and temper rolling and before hot stamping | | | | | | | | | | | Pearlite |
|---|---|---|---|---|---|---|---|---|---|---|---|---|---|---|
| Steel type reference symbol | Test reference symbol | Annealing condition Annealing temperature (° C.) | TS (MPa) | EL (%) | λ (%) | TS × EL (MPa · %) | TS × λ (MPa · %) | Ferrite area ratio (%) | Martensite area ratio (%) | Ferrite + martensite area ratio (%) | Residual austenite area ratio (%) | Bainite area ratio (%) | Pearlite area ratio (%) | area ratio before cold rolling (%) |
| A | 1 | 774 | 584 | 32.5 | 111 | 18980 | 64824 | 88 | 11 | 99 | 1 | 0 | 0 | 31 |
| B | 2 | 778 | 578 | 28.5 | 100 | 16473 | 57800 | 74 | 15 | 89 | 3 | 4 | 4 | 25 |
| C | 3 | 784 | 524 | 30.5 | 99 | 15982 | 51876 | 75 | 12 | 87 | 4 | 5 | 4 | 32 |
| D | 4 | 825 | 562 | 33.2 | 95 | 18658 | 53390 | 77 | 12 | 89 | 3 | 8 | 0 | 24 |
| E | 5 | 815 | 591 | 29.8 | 90 | 17612 | 53190 | 70 | 15 | 85 | 4 | 11 | 0 | 51 |
| F | 6 | 780 | 622 | 27.4 | 81 | 17043 | 50382 | 58 | 10 | 68 | 3 | 20 | 9 | 62 |
| G | 7 | 841 | 603 | 31.2 | 83 | 18814 | 50049 | 74 | 12 | 86 | 2 | 6 | 6 | 48 |
| H | 8 | 784 | 612 | 30.5 | 85 | 18666 | 52020 | 70 | 15 | 85 | 3 | 8 | 4 | 35 |
| I | 9 | 778 | 614 | 28.1 | 82 | 17253 | 50348 | 75 | 12 | 87 | 4 | 5 | 4 | 71 |
| J | 10 | 825 | 665 | 30.5 | 76 | 20283 | 50540 | 76 | 12 | 88 | 3 | 7 | 2 | 25 |
| K | 11 | 841 | 709 | 23.1 | 71 | 16378 | 50339 | 61 | 10 | 71 | 4 | 17 | 8 | 35 |
| L | 12 | 815 | 705 | 25.6 | 72 | 18048 | 50760 | 79 | 12 | 91 | 2 | 5 | 2 | 15 |

TABLE 3-continued

| Steel type reference symbol | Test reference symbol | Annealing condition Annealing temperature (° C.) | After annealing and temper rolling and before hot stamping TS (MPa) | EL (%) | λ (%) | TS × EL (MPa · %) | TS × λ (MPa · %) | Ferrite area ratio (%) | Martensite area ratio (%) | Ferrite + martensite area ratio (%) | Residual austenite area ratio (%) | Bainite area ratio (%) | Pearlite area ratio (%) | Pearlite area ratio before cold rolling (%) |
|---|---|---|---|---|---|---|---|---|---|---|---|---|---|---|
| M | 13 | 805 | 712 | 24.2 | 80 | 17230 | 56960 | 66 | 26 | 92 | 3 | 5 | 0 | 10 |
| N | 14 | 789 | 755 | 28.6 | 81 | 21593 | 61155 | 50 | 34 | 84 | 2 | 5 | 9 | 42 |
| O | 15 | 785 | 762 | 29.8 | 74 | 22708 | 56388 | 72 | 19 | 91 | 3 | 6 | 0 | 9 |
| P | 16 | 785 | 748 | 25.5 | 68 | 19074 | 50864 | 59 | 28 | 87 | 3 | 1 | 9 | 25 |
| Q | 17 | 841 | 780 | 20.1 | 71 | 15678 | 55380 | 78 | 18 | 96 | 0 | 4 | 0 | 31 |
| R | 18 | 845 | 783 | 20.1 | 65 | 15738 | 50895 | 41 | 44 | 85 | 4 | 5 | 6 | 51 |
| S | 19 | 789 | 805 | 20.4 | 74 | 16422 | 59570 | 42 | 38 | 80 | 4 | 10 | 6 | 46 |
| T | 20 | 785 | 789 | 22.2 | 71 | 17516 | 56019 | 44 | 40 | 84 | 3 | 12 | 1 | 18 |
| U | 21 | 805 | 845 | 20.2 | 62 | 17069 | 52390 | 41 | 38 | 79 | 5 | 12 | 4 | 22 |
| W | 22 | 778 | 922 | 17.4 | 61 | 16043 | 56242 | 41 | 39 | 80 | 4 | 12 | 4 | 15 |
| X | 23 | 804 | 988 | 15.5 | 51 | 15314 | 50388 | 42 | 46 | 88 | 2 | 4 | 6 | 45 |
| Y | 24 | 820 | 1012 | 17.4 | 51 | 17609 | 51612 | 45 | 37 | 82 | 2 | 16 | 0 | 42 |
| Z | 25 | 836 | 1252 | 13.5 | 45 | 16902 | 56340 | 41 | 48 | 89 | 2 | 9 | 0 | 10 |

TABLE 4

| Steel type reference symbol | Test reference symbol | Annealing condition Annealing temperature (° C.) | After annealing and temper rolling and before hot stamping TS (MPa) | EL (%) | λ (%) | TS × EL (MPa · %) | TS × λ (MPa · %) | Ferrite area ratio (%) | Martensite area ratio (%) | Ferrite + martensite area ratio (%) | Residual austenite area ratio (%) | Bainite area ratio (%) | Pearlite area ratio (%) | Pearlite area ratio before cold rolling (%) |
|---|---|---|---|---|---|---|---|---|---|---|---|---|---|---|
| AA | 26 | 804 | 577 | 27.2 | 77 | 15694 | 44429 | 59 | 10 | 69 | 2 | 12 | 17 | 35 |
| AB | 27 | 775 | 601 | 26.8 | 69 | 16107 | 41469 | 64 | 15 | 79 | 0 | 6 | 15 | 32 |
| AC | 28 | 754 | 513 | 28.9 | 74 | 14826 | 37962 | 62 | 12 | 74 | 2 | 5 | 19 | 25 |
| AD | 29 | 778 | 588 | 23.1 | 72 | 13583 | 42336 | 36 | 15 | 51 | 1 | 45 | 3 | 5 |
| AE | 30 | 780 | 595 | 27.9 | 69 | 16601 | 41055 | 73 | 10 | 83 | 2 | 3 | 12 | 66 |
| AF | 31 | 805 | 616 | 28.5 | 64 | 17556 | 39424 | 70 | 9 | 79 | 2 | 10 | 9 | 22 |
| AG | 32 | 812 | 632 | 28.6 | 52 | 18075 | 32864 | 58 | 20 | 78 | 2 | 9 | 11 | 25 |
| AH | 33 | 768 | 326 | 41.9 | 112 | 13659 | 36512 | 95 | 0 | 95 | 3 | 2 | 0 | 2 |
| AI | 34 | 781 | 1512 | 8.9 | 25 | 13457 | 37800 | 5 | 90 | 95 | 4 | 1 | 0 | 3 |
| AJ | 35 | 805 | 635 | 22.5 | 72 | 14288 | 45720 | 74 | 22 | 96 | 2 | 2 | 0 | 42 |
| AK | 36 | 789 | 625 | 31.2 | 55 | 19500 | 34375 | 75 | 22 | 97 | 2 | 1 | 0 | 15 |
| AL | 37 | 784 | 705 | 26.0 | 48 | 18330 | 33840 | 42 | 25 | 67 | 1 | 25 | 7 | 2 |
| AM | 38 | 841 | 795 | 15.6 | 36 | 12402 | 28620 | 30 | 52 | 82 | 3 | 10 | 5 | 14 |
| AN | 39 | 845 | 784 | 19.1 | 42 | 14974 | 32928 | 51 | 37 | 88 | 3 | 9 | 0 | 16 |
| AO | 40 | 826 | 602 | 30.5 | 35 | 18361 | 21070 | 68 | 21 | 89 | 4 | 7 | 0 | 22 |
| AP | 41 | 807 | 586 | 27.4 | 66 | 16056 | 38676 | 69 | 21 | 90 | 4 | 6 | 0 | 32 |
| AQ | 42 | 845 | 1254 | 7.5 | 25 | 9405 | 31350 | 11 | 68 | 79 | 4 | 11 | 6 | 22 |
| AR | 43 | 775 | 1480 | 9.6 | 26 | 14208 | 38480 | 12 | 69 | 81 | 3 | 16 | 0 | 5 |
| AS | 45 | 845 | 1152 | 12.0 | 42 | 13824 | 48384 | 41 | 35 | 76 | 0 | 23 | 1 | 5 |
| AT | 46 | 684 | 852 | 16.0 | 52 | 13632 | 44304 | 80 | 0 | 80 | 1 | 2 | 17 | 5 |
| AU | 47 | 912 | 1355 | 6.0 | 33 | 8130 | 44715 | 5 | 50 | 55 | 1 | 40 | 4 | 5 |
| AV | 48 | 805 | 1355 | 6.0 | 33 | 8130 | 44715 | 41 | 48 | 89 | 1 | 10 | 0 | 5 |

TABLE 5

| Test reference symbol | Hot stamping condition Thermal treatment temperature (° C.) | After hot stamping TS (MPa) | EL (%) | λ (%) | TS × EL (MPa · %) | TS × λ (MPa · %) | Ferrite area ratio (%) | Martensite area ratio (%) | Ferrite + martensite area ratio (%) | Residual austenite area ratio (%) | Bainite area ratio (%) | Pearlite area ratio (%) | Plating type *) | Note |
|---|---|---|---|---|---|---|---|---|---|---|---|---|---|---|
| 1 | 871 | 1512 | 8.5 | 41 | 12852 | 61992 | 10 | 82 | 92 | 1 | 7 | 0 | CR | Invention example |
| 2 | 861 | 1514 | 7.6 | 38 | 11506 | 57532 | 12 | 84 | 96 | 0 | 4 | 0 | GA | Invention example |
| 3 | 825 | 1612 | 8.1 | 37 | 13057 | 59644 | 8 | 81 | 89 | 1 | 5 | 5 | GI | Invention example |

TABLE 5-continued

| Test reference symbol | Hot stamping condition Thermal treatment temperature (° C.) | After hot stamping TS (MPa) | EL (%) | λ (%) | TS × EL (MPa · %) | TS × λ (MPa · %) | Ferrite area ratio (%) | Martensite area ratio (%) | Ferrite + martensite area ratio (%) | Residual austenite area ratio (%) | Bainite area ratio (%) | Pearlite area ratio (%) | Plating type *) | Note |
|---|---|---|---|---|---|---|---|---|---|---|---|---|---|---|
| 4 | 816 | 1658 | 7.4 | 40 | 12269 | 66320 | 11 | 86 | 97 | 3 | 0 | 0 | EG | Invention example |
| 5 | 901 | 1689 | 8.4 | 36 | 14188 | 60804 | 9 | 84 | 93 | 1 | 0 | 6 | Al | Invention example |
| 6 | 778 | 1745 | 8.2 | 37 | 14309 | 64565 | 10 | 82 | 92 | 3 | 5 | 0 | CR | Invention example |
| 7 | 885 | 1784 | 7.6 | 38 | 13558 | 67792 | 5 | 81 | 86 | 0 | 6 | 8 | CR | Invention example |
| 8 | 925 | 1795 | 9.2 | 40 | 16514 | 71800 | 0 | 89 | 89 | 3 | 8 | 0 | GA | Invention example |
| 9 | 955 | 1812 | 8.6 | 35 | 15583 | 63420 | 0 | 94 | 94 | 0 | 6 | 0 | GA | Invention example |
| 10 | 875 | 1815 | 9.1 | 34 | 16517 | 61710 | 0 | 100 | 100 | 0 | 0 | 0 | GA | Invention example |
| 11 | 851 | 1823 | 8.4 | 31 | 15313 | 56513 | 0 | 100 | 100 | 0 | 0 | 0 | GA | Invention example |
| 12 | 864 | 1855 | 8.2 | 36 | 15211 | 66780 | 0 | 97 | 97 | 2 | 0 | 1 | GI | Invention example |
| 13 | 865 | 1894 | 7.6 | 37 | 14394 | 70078 | 0 | 100 | 100 | 0 | 0 | 0 | GA | Invention example |
| 14 | 897 | 1912 | 9.2 | 35 | 17590 | 66920 | 5 | 90 | 95 | 0 | 5 | 0 | GA | Invention example |
| 15 | 880 | 1894 | 8.6 | 36 | 16288 | 68184 | 0 | 100 | 100 | 0 | 0 | 0 | GI | Invention example |
| 16 | 888 | 1912 | 8.4 | 37 | 16061 | 70744 | 0 | 94 | 94 | 0 | 6 | 0 | GA | Invention example |
| 17 | 955 | 1925 | 8.2 | 38 | 15785 | 73150 | 3 | 92 | 95 | 3 | 2 | 0 | GA | Invention example |
| 18 | 856 | 1945 | 7.6 | 40 | 14782 | 77800 | 0 | 100 | 100 | 0 | 0 | 0 | CR | Invention example |
| 19 | 841 | 1962 | 9.2 | 35 | 18050 | 68670 | 0 | 94 | 94 | 0 | 0 | 6 | GA | Invention example |
| 20 | 874 | 2012 | 8.6 | 34 | 17303 | 68408 | 0 | 100 | 100 | 0 | 0 | 0 | GI | Invention example |
| 21 | 884 | 2015 | 9.1 | 31 | 18337 | 62465 | 4 | 95 | 99 | 0 | 0 | 1 | EG | Invention example |
| 22 | 908 | 2025 | 7.8 | 36 | 15795 | 72900 | 0 | 100 | 100 | 0 | 0 | 0 | GA | Invention example |
| 23 | 925 | 2035 | 8.6 | 37 | 17501 | 75295 | 10 | 90 | 100 | 0 | 0 | 0 | Al | Invention example |
| 24 | 901 | 2145 | 8.7 | 35 | 18662 | 75075 | 0 | 87 | 87 | 1 | 10 | 2 | GA | Invention example |
| 25 | 865 | 2215 | 8.2 | 40 | 18163 | 88600 | 0 | 100 | 100 | 0 | 0 | 0 | CR | Invention example |

TABLE 6

| Test reference symbol | Hot stamping condition Thermal treatment temperature (° C.) | After hot stamping TS (MPa) | EL (%) | λ (%) | TS × EL (MPa · %) | TS × λ (MPa · %) | Ferrite area ratio (%) | Martensite area ratio (%) | Ferrite + martensite area ratio (%) | Residual austenite area ratio (%) | Bainite area ratio (%) | Pearlite area ratio (%) | Plating type *) | Note |
|---|---|---|---|---|---|---|---|---|---|---|---|---|---|---|
| 26 | 849 | 1754 | 20.1 | 26 | 35255 | 45604 | 8 | 77 | 85 | 0 | 5 | 10 | GA | Comparative example |
| 27 | 878 | 1792 | 16.1 | 26 | 28851 | 46592 | 5 | 74 | 79 | 0 | 12 | 9 | CR | Comparative example |
| 28 | 865 | 1817 | 15.4 | 26 | 27982 | 47242 | 3 | 81 | 84 | 0 | 3 | 13 | GA | Comparative example |
| 29 | 825 | 1823 | 16.5 | 27 | 30080 | 49221 | 8 | 76 | 84 | 3 | 11 | 2 | EG | Comparative example |
| 30 | 869 | 1988 | 14.9 | 25 | 29621 | 49700 | 6 | 78 | 84 | 0 | 7 | 9 | GI | Comparative example |
| 31 | 848 | 1965 | 13.6 | 25 | 26724 | 49125 | 8 | 77 | 85 | 0 | 11 | 4 | Al | Comparative example |

TABLE 6-continued

| Test reference symbol | Hot stamping condition Thermal treatment temperature (° C.) | After hot stamping TS (MPa) | EL (%) | λ (%) | TS × EL (MPa · %) | TS × λ (MPa · %) | Ferrite area ratio (%) | Martensite area ratio (%) | Ferrite + martensite area ratio (%) | Residual austenite area ratio (%) | Bainite area ratio (%) | Pearlite area ratio (%) | Plating type *) | Note |
|---|---|---|---|---|---|---|---|---|---|---|---|---|---|---|
| 32 | 876 | 1512 | 18.5 | 25 | 27972 | 37800 | 7 | 74 | 81 | 4 | 7 | 8 | CR | Comparative example |
| 33 | 835 | 1524 | 42.5 | 24 | 64770 | 36576 | 32 | 52 | 84 | 10 | 2 | 4 | GA | Comparative example |
| 34 | 895 | 2012 | 8.5 | 21 | 17102 | 42252 | 30 | 62 | 92 | 4 | 1 | 3 | GA | Comparative example |
| 35 | 888 | 1812 | 18.5 | 26 | 33522 | 47112 | 5 | 85 | 90 | 2 | 5 | 3 | GA | Comparative example |
| 36 | 846 | 1842 | 17.2 | 20 | 31682 | 36840 | 0 | 95 | 95 | 2 | 3 | 0 | GA | Comparative example |
| 37 | 805 | 1785 | 16.5 | 25 | 29453 | 44625 | 7 | 78 | 85 | 3 | 10 | 2 | GI | Comparative example |
| 38 | 863 | 1812 | 15.0 | 26 | 27180 | 47112 | 3 | 92 | 95 | 3 | 2 | 0 | GI | Comparative example |
| 39 | 878 | 1845 | 18.2 | 24 | 33579 | 44280 | 0 | 100 | 100 | 0 | 0 | 0 | GI | Comparative example |
| 40 | 899 | 2012 | 17.0 | 21 | 34204 | 42252 | 0 | 95 | 95 | 0 | 0 | 5 | GI | Comparative example |
| 41 | 905 | 1744 | 31.0 | 22 | 54064 | 38368 | 0 | 100 | 100 | 0 | 0 | 0 | EG | Comparative example |
| 42 | 923 | 2012 | 11.1 | 21 | 22333 | 42252 | 11 | 68 | 79 | 4 | 11 | 6 | Al | Comparative example |
| 43 | 907 | 2022 | 10.2 | 21 | 20624 | 42462 | 12 | 69 | 81 | 3 | 16 | 0 | GA | Comparative example |
| 45 | 845 | 2014 | 10.0 | 20 | 20140 | 40280 | 4 | 78 | 82 | 3 | 13 | 2 | GA | Comparative example |
| 46 | 879 | 2033 | 13.0 | 21 | 26429 | 42693 | 4 | 72 | 76 | 0 | 22 | 2 | GA | Comparative example |
| 47 | 886 | 2122 | 9.0 | 20 | 19098 | 42440 | 19 | 55 | 74 | 3 | 14 | 9 | GA | Comparative example |
| 48 | 914 | 2066 | 11.0 | 24 | 22726 | 49584 | 7 | 86 | 93 | 0 | 5 | 2 | GA | Comparative example |

TABLE 7

| Steel type reference symbo | Test reference symbol | Before hot stamping: Left side of Formula 2a | Before hot stamping: Determination | After hot stamping: Left side of Formula 2b | After hot stamping: Determination | Before hot stamping: Left side of Formula 3a | Before hot stamping: Determination | After hot stamping: Left side of Formula 3b | After hot stamping: Determination | Before hot stamping: Area ratio of 0.1 μm or larger MnS (%) | After hot stamping: Area ratio of 0.1 μm or larger MnS (%) |
|---|---|---|---|---|---|---|---|---|---|---|---|
| A | 1 | 1.02 | G | 1.02 | G | 15 | G | 16 | G | 0.005 | 0.005 |
| B | 2 | 1.03 | G | 1.03 | G | 18 | G | 17 | G | 0.011 | 0.011 |
| C | 3 | 1.04 | G | 1.04 | G | 12 | G | 10 | G | 0.005 | 0.007 |
| D | 4 | 1.01 | G | 1.01 | G | 14 | G | 18 | G | 0 006 | 0.006 |
| E | 5 | 1.06 | G | 1.06 | G | 11 | G | 14 | G | 0.007 | 0.008 |
| F | 6 | 1.06 | G | 1.06 | G | 10 | G | 10 | G | 0.008 | 0.003 |
| G | 7 | 1.06 | G | 1.06 | G | 11 | G | 10 | G | 0.004 | 0.008 |
| H | 8 | 1.03 | G | 1.03 | G | 16 | G | 17 | G | 0.008 | 0.005 |
| I | 9 | 1.07 | G | 1.07 | G | 18 | G | 16 | G | 0.006 | 0.006 |
| J | 10 | 1.08 | G | 1.08 | G | 10 | G | 11 | G | 0.007 | 0.007 |
| K | 11 | 1.09 | G | 1.09 | G | 6 | G | 6 | G | 0.006 | 0.006 |
| L | 12 | 1.08 | G | 1.08 | G | 6 | G | 8 | G | 0.008 | 0.008 |
| M | 13 | 1.06 | G | 1.06 | G | 8 | G | 7 | G | 0.009 | 0.009 |
| N | 14 | 1.07 | G | 1.07 | G | 13 | G | 14 | G | 0.003 | 0.003 |
| O | 15 | 1.06 | G | 1.06 | G | 3 | G | 5 | G | 0.011 | 0.011 |
| P | 16 | 1.08 | G | 1.08 | G | 18 | G | 17 | G | 0.007 | 0.005 |
| Q | 17 | 1.06 | G | 1.06 | G | 14 | G | 13 | G | 0.006 | 0.006 |
| R | 18 | 1.04 | G | 1.04 | G | 13 | G | 13 | G | 0.008 | 0.007 |
| S | 19 | 1.02 | G | 1.02 | G | 9 | G | 8 | G | 0.003 | 0.008 |
| T | 20 | 1.03 | G | 1.03 | G | 8 | G | 8 | G | 0.008 | 0.004 |
| U | 21 | 1.03 | G | 1.03 | G | 8 | G | 6 | G | 0.005 | 0.008 |
| W | 22 | 1.05 | G | 1.05 | G | 11 | G | 10 | G | 0.006 | 0.006 |

TABLE 7-continued

| | | | | | | | | | | | |
|---|---|---|---|---|---|---|---|---|---|---|---|
| X | 23 | 1.07 | G | 1.07 | G | 16 | G | 16 | G | 0.007 | 0.007 |
| Y | 24 | 1.06 | G | 1.06 | G | 16 | G | 17 | G | 0.006 | 0.005 |
| Z | 25 | 1.04 | G | 1.04 | G | 15 | G | 17 | G | 0.012 | 0.012 |

| Steel | Before hot stamping | | | | After hot stamping | | | |
|---|---|---|---|---|---|---|---|---|
| type reference symbo | n10 | n20 | Left side of Formula 4a | Determination | n1 | n2 | Left side of Formula 4b | Determination |
| A | 10 | 12 | 1.2 | G | 9 | 12 | 1.3 | G |
| B | 7 | 12 | 1.7 | B | 8 | 12 | 1.5 | B |
| C | 5 | 7 | 1.4 | G | 5 | 6 | 1.2 | G |
| D | 9 | 11 | 1.2 | G | 9 | 10 | 1.1 | G |
| E | 17 | 18 | 1.1 | G | 18 | 19 | 1.1 | G |
| F | 14 | 16 | 1.1 | G | 12 | 15 | 1.3 | G |
| G | 7 | 10 | 1.4 | G | 7 | 10 | 1.4 | G |
| H | 9 | 10 | 1.1 | G | 9 | 10 | 1.1 | G |
| I | 19 | 20 | 1.1 | G | 20 | 21 | 1.1 | G |
| J | 26 | 29 | 1.1 | G | 25 | 26 | 1.0 | G |
| K | 7 | 8 | 1.1 | G | 7 | 8 | 1.1 | G |
| L | 5 | 6 | 1.2 | G | 5 | 6 | 1.2 | G |
| M | 12 | 15 | 1.3 | G | 11 | 15 | 1.4 | G |
| N | 6 | 8 | 1.3 | G | 6 | 8 | 1.3 | G |
| O | 2 | 3 | 1.5 | B | 2 | 3 | 1.5 | B |
| P | 4 | 5 | 1.3 | G | 4 | 5 | 1.3 | G |
| Q | 7 | 9 | 1.3 | G | 7 | 9 | 1.3 | G |
| R | 16 | 18 | 1.1 | G | 15 | 18 | 1.2 | G |
| S | 10 | 12 | 1.2 | G | 10 | 12 | 1.2 | G |
| T | 6 | 7 | 1.2 | G | 6 | 7 | 1.2 | G |
| U | 8 | 10 | 1.3 | G | 7 | 9 | 1.3 | G |
| W | 16 | 20 | 1.3 | G | 15 | 20 | 1.3 | G |
| X | 23 | 26 | 1.1 | G | 22 | 25 | 1.1 | G |
| Y | 22 | 28 | 1.3 | G | 20 | 28 | 1.4 | G |
| Z | 20 | 31 | 1.6 | B | 22 | 32 | 1.5 | B |

TABLE 8

| | | Before hot stamping | | After hot stamping | | Before hot stamping | | After hot stamping | | Before hot stamping | After hot stamping |
|---|---|---|---|---|---|---|---|---|---|---|---|
| Steel type reference symbo | Test reference symbol | Left side of Formula 2a | Determination | Left side of Formula 2b | Determination | Left side of Formula 3a | Determination | Left side of Formula 3b | Determination | Area ratio of 0.1 μm or larger MnS (%) | Area ratio of 0.1 μm or larger MnS (%) |
| AA | 26 | 1.18 | B | 1.18 | B | 22 | B | 23 | B | 0.009 | 0.009 |
| AB | 27 | 1.15 | B | 1.15 | B | 21 | B | 19 | G | 0.008 | 0.008 |
| AC | 28 | 1.20 | B | 1.19 | B | 24 | B | 22 | B | 0.006 | 0.006 |
| AD | 29 | 1.14 | B | 1.13 | B | 22 | B | 25 | B | 0.007 | 0.007 |
| AE | 30 | 1.11 | B | 1.12 | B | 20 | B | 18 | G | 0.009 | 0.009 |
| AF | 31 | 1.12 | B | 1.14 | B | 22 | B | 21 | B | 0.002 | 0.002 |
| AG | 32 | 1.13 | B | 1.13 | B | 23 | B | 22 | B | 0.003 | 0.003 |
| AH | 33 | 1.16 | B | 1.16 | B | 21 | B | 21 | B | 0.004 | 0.004 |
| AI | 34 | 1.23 | B | 1.18 | B | 25 | B | 25 | B | 0.006 | 0.006 |
| AJ | 35 | 1.21 | B | 1.21 | B | 24 | B | 24 | B | 0.007 | 0.007 |
| AK | 36 | 1.16 | B | 1.15 | B | 21 | B | 21 | B | 0.006 | 0.007 |
| AL | 37 | 1.35 | B | 1.37 | B | 31 | B | 30 | B | 0.006 | 0.006 |
| AM | 38 | 1.32 | B | 1.32 | B | 30 | B | 31 | B | 0.006 | 0.006 |
| AN | 39 | 1.23 | B | 1.25 | B | 25 | B | 28 | B | 0.008 | 0.008 |
| AO | 40 | 1.34 | B | 1.33 | B | 30 | B | 32 | B | 0.004 | 0.004 |
| AP | 41 | 1.05 | G | 1.04 | G | 12 | G | 11 | G | 0.002 | 0.006 |
| AQ | 42 | 1.04 | G | 1.05 | G | 18 | G | 15 | G | 0.003 | 0.003 |
| AR | 43 | 1.13 | B | 1.14 | B | 26 | B | 26 | B | 0.002 | 0.002 |
| AS | 45 | 1.11 | B | 1.15 | B | 26 | B | 25 | B | 0.007 | 0.007 |
| AT | 46 | 1.25 | B | 1.27 | B | 26 | B | 27 | B | 0.004 | 0.005 |
| AU | 47 | 1.05 | G | 1.06 | G | 17 | G | 16 | G | 0.003 | 0.003 |
| AV | 48 | 1.12 | B | 1.13 | B | 21 | B | 23 | B | 0.005 | 0.005 |

TABLE 8-continued

| Steel type reference symbo | Before hot stamping n10 | n20 | Left side of Formula 4a | Determination | After hot stamping n1 | n2 | Left side of Formula 4b | Determination |
|---|---|---|---|---|---|---|---|---|
| AA | 13 | 15 | 1.2 | G | 12 | 15 | 1.3 | G |
| AB | 7 | 10 | 1.4 | G | 8 | 11 | 1.4 | G |
| AC | 14 | 19 | 1.4 | G | 13 | 18 | 1.4 | G |
| AD | 6 | 7 | 1.2 | G | 6 | 7 | 1.2 | G |
| AE | 12 | 15 | 1.3 | G | 12 | 15 | 1.3 | G |
| AF | 18 | 23 | 1.3 | G | 17 | 22 | 1.3 | G |
| AG | 6 | 7 | 1.2 | G | 6 | 7 | 1.2 | G |
| AH | 4 | 5 | 1.3 | G | 4 | 5 | 1.3 | G |
| AI | 12 | 14 | 1.2 | G | 12 | 13 | 1.1 | G |
| AJ | 15 | 17 | 1.1 | G | 15 | 17 | 1.1 | G |
| AK | 11 | 12 | 1.1 | G | 11 | 12 | 1.1 | G |
| AL | 12 | 17 | 1.4 | G | 12 | 17 | 1.4 | G |
| AM | 15 | 21 | 1.4 | G | 16 | 21 | 1.3 | G |
| AN | 10 | 12 | 1.2 | G | 10 | 11 | 1.1 | G |
| AO | 8 | 11 | 1.4 | G | 8 | 11 | 1.4 | G |
| AP | 6 | 8 | 1.3 | G | 6 | 8 | 1.3 | G |
| AQ | 12 | 15 | 1.3 | G | 12 | 15 | 1.3 | G |
| AR | 23 | 26 | 1.1 | G | 23 | 25 | 1.1 | G |
| AS | 16 | 18 | 1.1 | G | 15 | 18 | 1.2 | G |
| AT | 17 | 19 | 1.1 | G | 16 | 17 | 1.1 | G |
| AU | 18 | 20 | 1.1 | G | 16 | 18 | 1.1 | G |
| AV | 18 | 19 | 1.1 | G | 17 | 18 | 1.1 | G |

It is found from Tables 1 to 8 that, when the conditions of the present invention are satisfied, it is possible to obtain a high-strength cold rolled steel sheet satisfying TS×λ≥50000 MPa·%.

In addition, it is found that, when hot stamping is carried out under predetermined hot stamping conditions, the cold rolled steel sheet of the present invention satisfies TS×λ50000 MPa·% even after hot stamping.

INDUSTRIAL APPLICABILITY

According to the present invention, since an appropriate relationship is established among the amount of C, the amount of Mn and the amount of Si and martensite is given an appropriate hardness measured using a nanoindenter, it is possible to provide a cold rolled steel sheet capable of obtaining favorable hole expansibility.

BRIEF DESCRIPTION OF THE REFERENCE SYMBOLS

S1: MELTING PROCESS
S2: CASTING PROCESS
S3: HEATING PROCESS
S4: HOT ROLLING PROCESS
S5: COILING PROCESS
S6: PICKLING PROCESS
S7: COLD ROLLING PROCESS
S8: ANNEALING PROCESS
S9: TEMPER ROLLING PROCESS
S11: HOT DIP GALVANIZING PROCESS
S12: ALLOYING TREATMENT PROCESS
S13: ALUMINIZING PROCESS
S14: ELECTROGALVANIZING PROCESS

The invention claimed is:

1. A cold rolled steel sheet comprising, by mass %:
C: more than 0.150% to 0.300%;
Si: 0.010% to 1.000%;
Mn: 1.50% to 2.70%;
P: 0.001% to 0.060%;
S: 0.001% to 0.010%;
N: 0.0005% to 0.0100%; and
Al: 0.010% to 0.050%, and
optionally one or more of:
B: 0.0005% to 0.0020%;
Mo: 0.01% to 0.50%;
Cr: 0.01% to 0.50%;
V: 0.001% to 0.100%;
Ti: 0.001% to 0.100%;
Nb: 0.001% to 0.050%;
Ni: 0.01% to 1.00%;
Cu: 0.01% to 1.00%;
Ca: 0.0005% to 0.0050%; and
REM: 0.0005% to 0.0050%, and
a balance including Fe and unavoidable impurities,
wherein, when an amount of C, an amount of Si and an amount of Mn are respectively represented by [C], [Si] and [Mn] in unit mass %, a relationship of the following formula 1 is satisfied,
a metallographic structure contains, by area ratio, 40% to 90% of a ferrite and 10% to 60% of a martensite, and further contains one or more of 10% or less of a pearlite by area ratio, 5% or less of a retained austenite by volume ratio and 20% or less of a bainite by area ratio,
a hardness of the martensite measured using a nanoindenter satisfies the following formulae 2a and 3a, and
TS×λ, representing a product of TS that is a tensile strength and X, that is a hole expansion ratio is 50000 MPa·% or more, $$(5\times[Si]+[Mn])/[C]>10 \quad (1)$$

$$H20/H10<1.10 \quad (2a)$$

$$\sigma HM0<20 \quad (3a)$$

here, the H10 represents an average hardness of the martensite at the surface part of the cold rolled steel sheet, the H20 represents an average hardness of the martensite at a center portion of a sheet thickness that occupies a ±100 μm range from a sheet thickness center of the cold rolled steel sheet in a thickness direction, and the σHM0 represents a variance of the hardness of the martensite present in the center portion of the sheet thickness.

2. The cold rolled steel sheet according to claim 1, wherein an area ratio of an MnS that is present in the metallographic structure and has an equivalent circle diameter in a range of 0.1 μm to 10 μm is 0.01% or less, and the following formula 4a is satisfied, $$n20/n10<1.5 \quad (4a)$$

here, the n10 represents an average number density of the MnS per 10000 $\mu m^2$ at a ¼ part of the sheet thickness of the cold rolled steel sheet, and the n20 represents an average number density of the MnS per 10000 $\mu m^2$ at the center portion of the sheet thickness.

3. The cold rolled steel sheet according to claim 1, wherein, additionally, after a hot stamping including a heating at a temperature in a range of 750° C. to 1000° C., a working and a cooling, is carried out, the hardness of the martensite measured using a nanoindenter satisfies the following formulae 2b and 3b, the metallographic structure contains 80% or more of a martensite by area ratio, optionally, further contains one or more of 10% or less of a pearlite by area ratio, 5% or less of a retained austenite by volume ratio, less than 20% of a ferrite and less than 20% of a bainite by area ratio, and TS×λ representing the product of TS that is the tensile strength and λ that is the hole expansion ratio is 50000 MPa·% or more, $$H2/H1<1.10 \quad (2b)$$

$$\sigma HM<20 \quad (3b)$$

here, the H1 represents an average hardness of the martensite at the surface part after the hot stamping, the H2 represents an average hardness of the martensite at the center portion of the sheet thickness after the hot stamping, and the σHM represents a variance of the hardness of the martensite present at the center portion of the sheet thickness after the hot stamping.

4. The cold rolled steel sheet according to claim 3, wherein an area ratio of MnS that is present in the metallographic structure and has an equivalent circle diameter in a range of 0.1 μm to 10 μm is 0.01% or less, and the following formula 4b is satisfied, $$n2/n1<1.5 \quad (4b)$$

here, the n1 represents an average number density of the MnS per 10000 $\mu m^2$ at a ¼ part of the sheet thickness in the cold rolled steel sheet after the hot stamping, and the n2 represents an average number density of the MnS per 10000 $\mu m^2$ at the center portion of the sheet thickness after the hot stamping.

5. The cold rolled steel sheet according to any one of claims 1 to 4, wherein a hot-dip galvanized layer is further formed on a surface of the cold rolled steel sheet.

6. The cold rolled steel sheet according to claim 5, wherein the hot-dip galvanized layer includes a galvannealed layer.

7. The cold rolled steel sheet according to any one of claims 1 to 4, wherein an electrogalvanizing layer is further formed on a surface of the cold rolled steel sheet.

8. The cold rolled steel sheet according to any one of claims 1 to 4, wherein an aluminizing layer is further formed on a surface of the cold rolled steel sheet.

9. A manufacturing method of manufacturing a cold rolled steel sheet according to claim 1, the method comprising:

casting molten steel having the chemical components according to claim 1 and obtaining a steel;

heating the steel;

hot-rolling the steel using a hot rolling facility having a plurality of stands;

coiling the steel after the hot rolling;

pickling the steel after the coiling;

cold-rolling the steel after the pickling using a cold rolling mill having a plurality of stands under conditions in which the following formula 5 is satisfied;

heating the steel at a temperature in a range of 700° C. to 850° C. and cooling the steel after the cold rolling; and temper-rolling the steel after the heating and cooling of the steel, $$1.5\times r1/r+1.2\times r2/r+r3/r>1.0 \quad (5)$$

wherein r1, r2 and r3 each represent an individual target cold rolling reduction in an $i^{th}$ stand from the uppermost stand among a plurality of the stands in the cold rolling in unit %, and r represents a total cold rolling reduction In the cold rolling in unit %.

10. The manufacturing method of manufacturing a cold rolled steel sheet according to claim 9, wherein, when a coiling temperature in the coiling is represented by CT in unit ° C.; and an amount of C, an amount of Mn, an amount of Cr and an amount of Mo of the steel are respectively represented by [C], [Mn], [Cr] and [Mo] in unit mass %, the following formula 6 is satisfied, $$560-474\times[C]-90\times[Mn]-20\times[Cr]-20\times[Mo]<CT<830-270\times[C]-90\times[Mn]-70\times[Cr]-80\times[Mo] \quad (6).$$

11. The manufacturing method of manufacturing a cold rolled steel sheet according to claim 9 or 10, wherein, when a heating temperature in the heating is represented by T in unit ° C.; an in-furnace time is represented by t in unit minute; and an amount of Mn and an amount of S in the steel are respectively represented by [Mn] and [S] in unit mass %, the following formula 7 is satisfied, $$T\times\ln(t)/(1.7\times[Mn]+[S])>1500 \quad (7).$$

12. The manufacturing method of manufacturing a cold rolled steel sheet according to claim 9 or 10, further comprising:

hot dip galvanizing on the steel is further provided between the annealing and the temper rolling.

13. The manufacturing method of manufacturing a cold rolled steel sheet according to claim 12, further comprising:

alloying the steel between the hot dip galvanizing and the temper rolling.

14. The manufacturing method of manufacturing a cold rolled steel sheet according to claim 9 or 10, further comprising:

electrogalvanizing the steel after the temper rolling.

15. The manufacturing method of manufacturing a cold rolled steel sheet according to claim 9 or 10, further comprising:

aluminizing the steel between the annealing and the temper rolling.

16. The manufacturing method of manufacturing a cold rolled steel sheet according to claim 11, further comprising: hot dip galvanizing on the steel is further provided between the annealing and the temper rolling.

17. The manufacturing method of manufacturing a cold rolled steel sheet according to claim 16, further comprising: alloying the steel between the hot dip galvanizing and the temper rolling.

18. The manufacturing method of manufacturing a cold rolled steel sheet according to claim 11, further comprising: electrogalvanizing the steel after the temper rolling.

19. The manufacturing method of manufacturing a cold rolled steel sheet according to claim 11, further comprising: aluminizing the steel between the annealing and the temper rolling.

* * * * *